US006315163B1

(12) United States Patent
Shu

(10) Patent No.: US 6,315,163 B1
(45) Date of Patent: Nov. 13, 2001

(54) SOUND EMITTING DISPENSER

(75) Inventor: Lu Pao Shu, Taipei (TW)

(73) Assignee: Allure Home Creation Co., Inc., Boonton, NJ (US)

( * ) Notice: Subject to any disclaimer, the term of this patent is extended or adjusted under 35 U.S.C. 154(b) by 0 days.

(21) Appl. No.: 09/474,656

(22) Filed: Dec. 29, 1999

(51) Int. Cl.[7] ..... B67D 5/22

(52) U.S. Cl. ..... 222/39; 222/78; 446/397; 446/475

(58) Field of Search ..... 22/39, 78; 446/297, 446/397, 475

(56) References Cited

U.S. PATENT DOCUMENTS

| | | | | |
|---|---|---|---|---|
| 790,111 | | 5/1905 | Crossley . | |
| 868,632 | | 10/1907 | Almstrom et al. . | |
| 3,230,661 | | 1/1966 | Gleason . | |
| 3,627,161 | | 12/1971 | Wergeland . | |
| 3,660,930 | | 5/1972 | Indjian . | |
| 4,674,654 | | 6/1987 | Fujii et al. . | |
| 4,869,381 | | 9/1989 | Agner . | |
| 4,898,060 | | 2/1990 | To . | |
| 4,944,704 | * | 7/1990 | Grace | 446/297 |
| 4,978,030 | | 12/1990 | Morris et al. . | |
| 4,979,629 | | 12/1990 | Askerneese . | |
| 4,991,755 | | 2/1991 | Grusmark . | |
| 5,033,631 | | 7/1991 | Nightingale . | |
| 5,213,234 | * | 5/1993 | Stefanopoulos | 222/39 |
| 5,230,648 | * | 7/1993 | Kelley et al. | 222/78 |
| 5,301,836 | * | 4/1994 | Luu | 222/78 |
| 5,456,626 | * | 10/1995 | Ming-Kang | 446/475 |
| 5,489,893 | | 2/1996 | Jo et al. . | |
| 5,738,232 | * | 4/1998 | Roberts et al. | 222/78 |
| 5,960,991 | | 10/1999 | Ophardt . | |
| 6,024,625 | | 2/2000 | Pearce . | |
| 6,104,292 | | 8/2000 | Rombom et al. . | |

FOREIGN PATENT DOCUMENTS

| | | | | |
|---|---|---|---|---|
| 1260873 | * | 9/1989 | (CA) | 222/39 |
| 583956 B1 | | 5/1997 | (EP) . | |

* cited by examiner

*Primary Examiner*—Philippe Derakshani
(74) *Attorney, Agent, or Firm*—Frommer Lawrence & Haug LLP; Edgar H. Haug; Grace L. Pan

(57) ABSTRACT

Claimed and disclosed is a sound emitting and dispensing device comprising a pressure-activated dispenser. The pressure-activated device has a top end with means for a user to apply pressure and engage the dispenser and dispense therefrom and a bottom end. The device according to the present invention also has a pedestal including a bottom end for sitting on a surface and a top end having means for optionally and removably receiving the bottom end of the pressure-activated dispenser, and a pressure-activated sound emitting device positioned in the meals for optionally removably receiving the bottom end of the pressure-activated dispenser. The pressure-activated dispenser is optionally removably connected to the pedestal and the pressure-activated sound emitting device is positioned beneath and in direct contact with the dispenser such that when the pressure-activated dispenser is so connected to the pedestal and pressure is applied to the top end of the dispenser, the sound emitting device is activated.

9 Claims, 33 Drawing Sheets

Top View of Dispenser

Top View of Base

Bottom View of Base

Side View of the Sound Emitting Pump Dispenser

FIGURE 23a
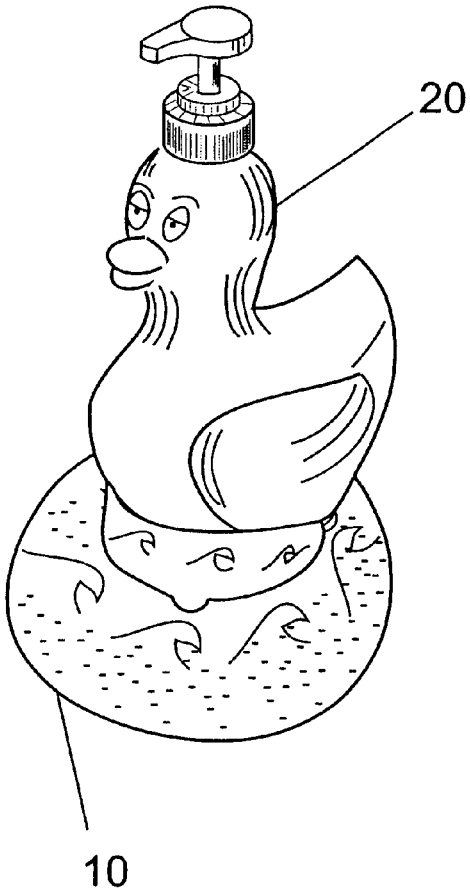
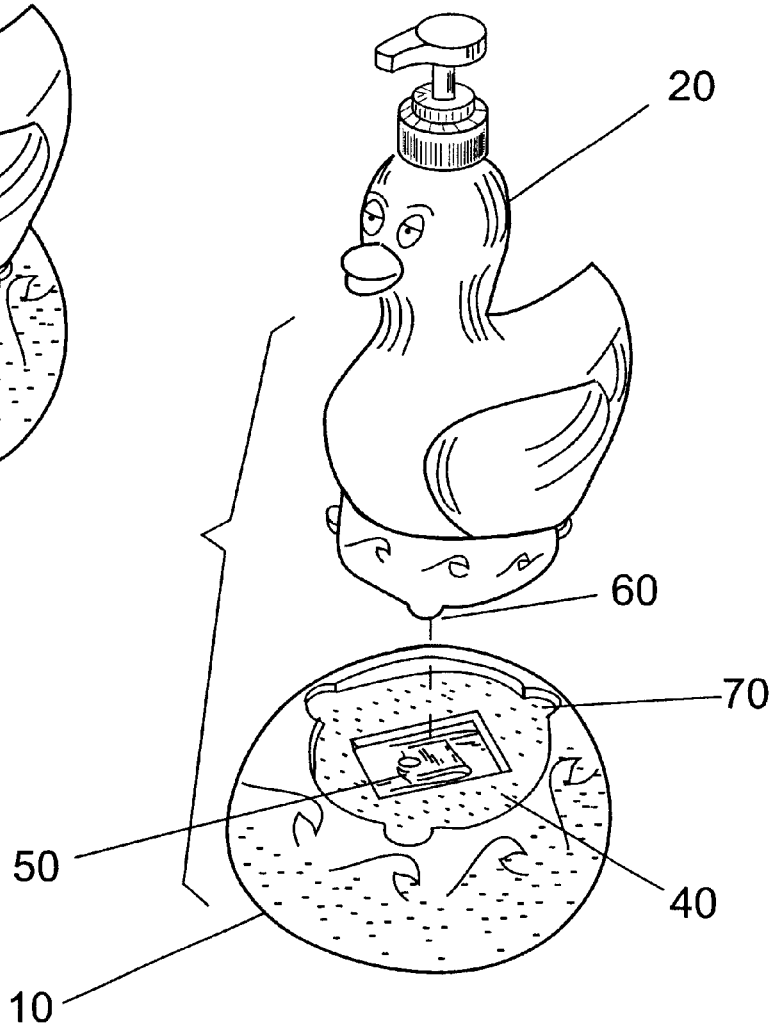
FIGURE 23b

FIGURE 26c
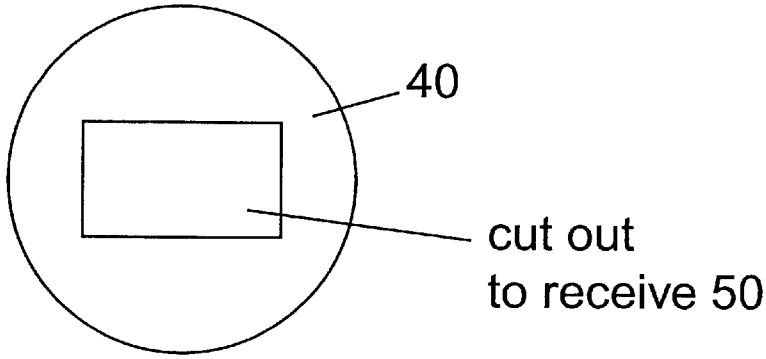
FIGURE 26d
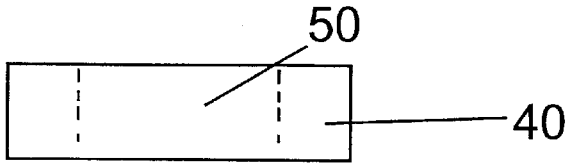
FIGURE 26e
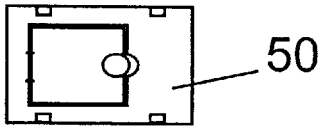
FIGURE 26f
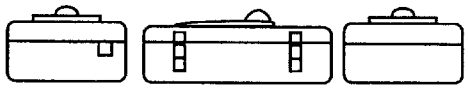
FIGURE 26g
FIGURE 26h
FIGURE 26i
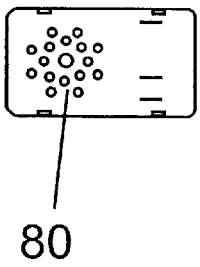

SOUND EMITTING DISPENSER

RELATED APPLICATIONS

Reference is made to U.S. patent application Ser. No. 08/844,225 filed Apr. 18, 1997, which claims priority from Taiwanese Patent Application No.: 86200066, filed on Jan. 15, 1997 and Chinese Patent Application No. 97204313.7, 1997 filed on Feb. 3, 1997 and U.S. Provisional Patent Application Serial No. 60/089,873 filed Jun. 19, 1998, all of which are incorporated herein by reference.

FIELD OF THE INVENTION

The present invention relates to a dispenser; for instance, a sound-emitting dispenser, e.g., a dispenser including a sound-emitting device.

The invention relates to such a dispenser wherein the dispenser portion thereof can be any pressure-activated dispenser. Such a pressure-activated dispenser can involve a point on the dispenser that a user applies pressure; for instance, to depress an activator. The pressure-activated dispenser may be set relatively stationary on a surface, such as a sink, countertop, dresser, or the like.

The invention relates further to employing the pressure that a user is applying to activate the pressure-activated dispenser to also activate a sound emitting device; for instance, by locating a pressure-activated sound emitting device between the base or lower surface of a pressure-activated dispenser (such as a pressure activated dispenser having an actuator at a position where there is at least some downward force applied to dispense) and the stationary surface; or, by locating a pressure-activated sound emitting device at a point where the pressure from activating the dispenser also activates the pressure-activated sound emitting device (e.g., an aerosol top that has a pressure-activated sound emitting device positioned on the upper surface contacted by the user so that activating the aerosol to spray also activates the sound emitting device).

Alternatively or additionally, the dispenser can have a container portion to which there is connected an activator for dispensing and a cover portion that is in a surrounding relation to the container, within which the container may transmit pressure to the sound emitting device to activate it, when pressure is applied to the activator to dispense; for instance, the cover portion can have a base and there is a pressure-activated sound emitting device between the outer surface of the base of the container and the inside surface of the cover, such that a user can grip the outside surface of the cover, apply pressure to the activator to dispense and that pressure is transmitted to the sound emitting device to thereby activate it too.

The invention can yet further relate such dispensers wherein the sound emitting device can be any such device that emits sound in response to pressure activation. Such a sound emitting device can be an electronic sound emitting device that has a pre-programmed noise, word, phrase, music, or other desired audio signal or sound. Optionally or alternatively, the invention can relate to such dispensers wherein the sound emitting device can record and playback a noise, word, phrase, music, or other desired audio signal or sound.

Further optionally or alternatively, the invention can relate to such dispensers wherein the sound emitting device can include a VOX—a voice activated (or sound activated) switch—for instance, a switch that can activate the play and/or recordation of the noise, word, phrase, music, or other desired audio signal or sound. Also optionally or alternatively, the sound emitting device can include another or a different switch or other switches, such as a light sensitive switch; for instance, a switch that allows the sound emitting device to be activated when there is light and not activated when there is no light (so, for example, if the dispenser is in a relatively dark setting, such as a bathroom at night, the dispenser will not emit a sound when used, but it will do so when there is light, such as during the day).

Also optionally or alternatively, the invention even further still can relate to such dispensers wherein the sound emitting device is a mechanical sound emitting device; for instance, a sound emitting device that emits a sound as a result of air being forced into or out of it (e.g., like a squeak or squeeze toy).

And, even further still, the invention can relate to such dispensers wherein the sound emitting device includes or is a transmitter; for instance, instead of or in addition to emitting an audio signal, the device emits a signal in response to pressure activation; e.g., the signal can be an IR or other suitable signal; and, there can be a remote receiver that receives the signal and performs a function, such as emitting a noise, word, phrase, music or other desired audio signal or sound. The remote receiver can receive signals from various dispensers and perform a particular function, e.g., emit a particular noise, word, phrase, music or other desired audio signal or sound, for each particular signal. (Thus, "sound emitting device" can include any or all of the foregoing; and, "sound" emitted by the "sound emitting device" can include audio sound and/or the transmission of a signal that is other than audio, e.g., somewhere in the electromagnetic spectrum such as an IR, infra-red or RF radio frequency signal.) For example, the dispenser can be for soap or another liquid typically dispensed in a particular room such as a bathroom or kitchen and the remote receiver/sound emitter can be within another article commonly found in the room, e.g., a toilet paper dispenser, a tissue dispenser, etc.

The invention even further still can relate to such a dispenser that is for a fluid, e.g., a liquid or a gas, advantageously a liquid, and more advantageously the dispenser is a pump-type or pressure-activated dispenser such as, a dispenser for a lotion, soap, detergent, fragrance, perfume, Eau de Parfum, toilet water, cologne, toothpaste, or the like. The dispenser is preferably designed to be decorative and sound emitting.

The dispenser can generate a sound that is consistent with the sound that would be made by the shape depicted by the pump dispenser, when the dispenser is activated and thus, entertain the young and old users of the dispenser. For example, if the dispenser is shaped like a cow, it can emit a "moo" sound when the dispenser is activated. Thus, the invention relates to dispensers that can be entertaining.

Further, the ability of the dispenser to emit a sound when activated can assist those who are blind or visually impaired; for instance, by emitting a sound when the dispenser is activated, a blind or visually impaired person can have sound or audio confirmation that the liquid was dispensed. And moreover, that person can have different dispensers for different liquids; for example, hand soap can be shaped like a cow and emit a "moo", toothpaste can be a cat and emit a "meow" and cologne can be a "rooster" and emit a "cock-a-doodle do", such that when the visually-impaired person wants soap, if he hears a "moo", he knows he has dispensed soap into his hand, whereas if he hears the "meow" of the cat or the crow of the rooster, he knows he does not have soap.

Alternatively and/or additionally, the dispenser can play music; for example, a "cow" could play "Hey Diddle Diddle", or be otherwise shaped and emit music (e.g., be shaped like a baseball bat and play "Take Me Out To The Ballpark" or be shaped otherwise, e.g., like a musical instrument, and play a portion of a song, melody or tune).

Or, alternatively and/or additionally, the dispenser can include a sound emitting device that emits a word or phrase, such as "soap" with the dispenser including that word or phrase on its outer surface so that it can be seen or felt or both by the user, e.g., raised letters, such as raised Braille letters or raised enlarged letters for those who visually read, so as to assist a blind or visually impaired person; or to be an educational tool for a child. The dispenser can be in a decorative shape and the word or phrase can be an identifying word or phrase, e.g., the dispenser can be shaped like a cow and emit the word "cow", and/or also have that word on it, so that the dispenser can be an educational tool.

Even further still, the invention can relate to such a dispenser wherein there is a VOX, and in response to a sound such as that of the flow of water in a sink or the flush of a toilet, the sound emitting device emits a sound, such as a phrase, e.g., "remember to wash hands" or "remember to brush teeth"; and, when activated thereafter, it can emit a different sound such as a phrase, e.g., "soap" or "toothpaste" and/or "good job", and/or the dispenser can also have a word on its outer surface, e.g., "soap" or "toothpaste" to thereby encourage use of sanitary products and sanitary behavior by younger users and/or to be an educational tool.

Accordingly, the invention can relate to dispensers that are educational tools, e.g., promote good sanitary or other behavior and/or teach a word and/or assist those who are blind or visually impaired and/or that are entertaining.

The invention also relates to methods for making and using such a dispenser, as well as methods of making and using components of such a dispenser for constructing and using the dispenser.

Various documents may be mentioned in this text; and, each herein mentioned document and each document cited or referenced in each herein mentioned document, is hereby incorporated herein by reference.

BACKGROUND OF THE INVENTION

Dispensers for liquids, particularly for cleansing solutions such as shampoo, are dispensed from open-mouthed bottles, but, open-mouthed bottles do not allow the user to dispense a particularly amount.

Dispensers for liquids are varied. Cleansing solutions such as shampoo are dispensed from open-mouthed bottles, but open-mouth bottles do not allow the user to dispense a particular amount.

There are also pump-type dispensers. Conventional pump-type dispensers include a pumping means having dispensing tube and an actuator. A user depresses the actuator which forces gas into the dispensing tube and into a stationary bottle (with respect to the actuation or pump nozzle). This creates a vacuum that forces the liquid in the bottle to rise within a tube and exit from the actuator. The actuator of a pump-type dispenser is typically positioned at the top of the bottle. Pump-type dispensers are also used to dispense liquids such as cleansing solutions, (e.g., shower gel, shampoo) or lotions or hair conditioner. The actuator that serves as a dispensing means can be a conventional pump-type activator, it can also be an activator with a nozzle or an aerosol activator.

In many ways a different and novel dispenser for liquids, preferably for cleansing solution, lotion, shower gel, shampoo, conditioner or the like, is desired. The appearance or design of a dispenser is desirably aesthetically pleasing and if possible to entertain the user young or old.

However, meeting these desires has been hampered by the functional limitation of the pump spray dispenser, namely, that the actuator must be depressed to deliver the liquid.

Presently available dispensers for shower gel or for shampoo are predominantly made from blow-molding a container; a dispensing/actuator mechanism removably attaches at the top the container to allow refilling (e.g., via threads at the top of the container). The dispensers can have a design printed on the outer surface of the container, or animals or cartoon characters on top of the actuators, to make the dispenser attractive. However, these dispensers do not provide any decorative value once emptied. These dispensers are generally not useful as a decoration. Thus, the end result is that these dispensers are discarded thus, creating an adverse effect on the environment. Accordingly, it would be desirable to provide an aesthetically pleasing dispenser which would encourage the user to reuse it, and therefore reduce the burden on the environment by users summarily discarding dispensers when empty.

Although a sculptured dispenser is commonly available, sculpted dispensers are not interactive. It would be desirable if a dispenser, when activated to dispense, can generate a sound or music or phrase or the like; thus, for instance, as to younger users, the dispenser can encourage them to wash their hands, and/or for the older or visually impaired users, the dispenser can let them know the contents in the dispenser, and/or for all other general users, the sound emitting liquid dispenser can provide some entertaining dialogue, music, or sound (as in the present invention). Furthermore, once the liquid in the dispenser is exhausted, the dispenser can be used as a household decorative item or the reservoir where the liquid is disposed of can be refilled which will evidently decrease the production of non-biodegradable waste.

With respect to dispensers, reference is made to the following:

U.S. Pat. No. 5,258,209 Bankert et al. relates to a decorative device for displaying an ornamental object within a fluid. The device takes the form of a transparent hollow bell-shaped enclosure, the interior of the enclosure containing a fluid and a plurality of small particles. A handle is attached to the crown of the enclosure. A fluid tight base is sealingly connected to the mouth of the enclosure.

Luu, U.S. Pat. No. 5,301,836, is directed to a liquid dispenser having movable head as pump actuator. More specifically, a plastic container in the shape of an animal body for holding liquid.

Litton et al., U.S. Pat. No. Des. 318,794, provides an ornamental design for a combined bottle and cap.

Dinand, U.S. Pat. No. Des. 365,020, relates to an ornamental design for a combined cosmetic container and cap.

Maddox, U.S. Pat. No. Des. 346,548, is directed to an ornamental design for a combined pump dispenser and cap.

Kuzma, U.S. Pat. No. Des. 348,388, is concerned with an ornamental design for a pump dispenser. Crawford, U.S. Pat. No. Des. 370,636, is directed to an ornamental design for the body for a bottle.

Costa, U.S. Pat. No. Des. 352,234, relates to an ornamental design for a pump dispenser.

Crawford, U.S. Pat. No. Des. 376,310 provides an ornamental design for a bottle.

Each of these patents provides either a dispenser or a fluid-containing device for displaying an ornamental object within the fluid. None of these patents discloses or suggests a dispenser that emits a sound when activated, e.g., a dispenser having a pump dispenser and a pedestal that are matingly fitted with each other wherein the pump dispenser having a sculptured appearance and the pedestal contains within it a flexible member and a pressure activated sound emitting device, wherein the pump dispenser has a reservoir capable of containing cleansing solution, with pump dispensing apparatus and when the actuator of the pump dispenser is compressed, will activate the sound emitting device imbedded within the pedestal; or, methods for making and using such a dispenser.

Thus, it is believed that heretofore the present invention has not been taught or suggested.

OBJECTS AND SUMMARY OF THE INVENTION

It is therefore an object of the invention to provide a novel dispenser.

It is also an object of the invention to provide a dispenser which is suitable for dispensing a lotion, shampoo, detergent, liquid soap, conditioner or the like.

It is yet a further object of the invention to provide a dispenser that is interactive with its user and/or that emits a sound, noise, phrase, music, or the like, when activated to dispense.

It is still yet another object of the invention to provide a dispenser having a sculptured appearance wherein the sound generated corresponds with the appearance of the sculpture. For example, if the dispenser is in the shape of a cat, then the sound generated would be consistent with that made by a cat (e.g., "meow").

Thus, the present invention provides a dispenser including a sound emitting device; for instance, a pressure-activated dispenser including a sound emitting device wherein pressure for dispensing from the dispenser also activates the sound emitting device; e.g., pressure for dispensing is translated through the pressure activated dispenser to provide pressure to the sound emitting device and thereby activate it. Accordingly, the invention can provide a sound emitting and dispensing device comprising: a pressure-activated dispenser; and a pressure-activated sound emitting device; whereby the pressure-activated dispenser and the pressure-activated sound emitting device are connected and pressure activating the dispenser activates the sound emitting device. The dispenser and the sound emitting device can be connected in such a manner that they are directly in contact with each other, or otherwise, e.g., whereby they are indirectly connected—an intervening member, piece or element prevents direct contact but allows for transmission of pressure that is for activating the dispenser to also activate the sound emitting device.

For instance, the invention can provide a sound emitting and dispensing device comprising: a pump-spray dispenser, a pedestal positioned beneath the dispenser, a pressure activated sound emitting device positioned in the pedestal beneath the dispenser, and a flexible member positioned within the pedestal, supporting the dispenser, such that when the dispenser is not activated, the sound emitting device is not activated, and when the pump dispenser is activated, the flexible member is compressed, and the pressure activated sound emitting device is activated and sound is emitted. The flexible member can be any suitable material or a foam cushion with memory, e.g., a spring fabricated from metal or plastic or a memory foam material; and, the flexible member can be in a surrounding relationship with respect to the pressure activated sound emitting device.

Accordingly, in an embodiment the present invention provides a sound emitting dispenser for dispensing a fluid such as a liquid and for emitting a sound, in response to pressure, e.g., for dispensing liquid from a pump nozzle bottle having a pump nozzle from which liquid dispenses, the dispenser including a container, vessel or bottle to which is connected the pump nozzle (actuator), and, a pedestal upon which the dispenser sits, e.g., into and/or upon which the dispenser matingly fits, wherein a pressure activated sound emitting device and a flexible member are placed within the pedestal; and, when the actuator of the dispenser is activated, the pressure of activation of the dispenser can cause the dispenser to come into contact with the pressure activated sound emitting device so as to cause the liquid to dispense from the pump nozzle and at the same time activate the sound emitting device to generate a sound, such as a pre-programmed sound.

In another embodiment, the dispenser is sculptured to resemble an animal, such as a member in the fish family (e.g., goldfish, tropical fish), or a member in amphibian family (e.g., frog, toad, salamander), or a member in the reptile family (e.g., crocodile, alligator, turtle, tortoise), a member of the bird family (e.g., duck, goose, crow, rooster, chicken) or a member in the mammal family (e.g., cow, cat, dog, sheep, lamb, rabbit, hare). Advantageously, the dispenser is in a form selected from the group consisting of: a dog, a cat, a rooster, a duck, a dolphin, a cow, a tiger, a rabbit, a dragon, a snake, a horse, a sheep, a monkey, a pig, an insect (e.g., bee, fly, ladybug, ant, butterfly) and a seal; or, the dispenser is in a form dispenser of a plant or of an inanimate object, such as a tree, a mountain, and a flower, an electrical appliance, a locomotive or train, a car, an airplane, a jet, a space shuttle, a truck, a car (or generally, transportation means), a volcano, a building or structure (e.g., a house a building or structure such as the Eiffel Tower, the World Trade Center, etc.), a sport equipment (bat, ball, hockey stick, etc), furniture, or any and all other inanimate object, animate object, animal, etc. For instance, the dispenser can be shaped like a caricature of a famous person or character, and the sound emitting device can emit a quote or phrase from that person or character (e.g., a "Clint Eastwood" or "Dirty Harry" or "George Bush" dispenser that emits the phrase "Read My Lips" when activated, or a "Bugs Bunny" dispenser that emits the phrase "What's Up Doc?" when activated, and the like). And thus, the pressure activated sound emitting device can advantageously produce a sound that is consistent with the appearance of the sculptured dispenser.

In a preferred embodiment of the invention the means to dispense the liquid is accomplished by an actuator having a flat surface that enables a user to introduce air into a container that is connected to the actuator whereby pressure forces the liquid in the container into a tube connected to the actuator and out the opening of the actuator.

In another preferred embodiment of the invention, the actuator can have a nozzle. In yet another preferred embodiment of the invention, the actuator can be an aerosol spray.

In this text, the terms "comprising", "comprise", "comprises" and other forms of "comprise" can have the meaning ascribed to these terms in U.S. Patent Law and can mean "including", "include", "includes" and other forms of "include".

These and other objects and embodiments of the invention are provided in, or are obvious from, the following detailed description of the invention.

BRIEF DESCRIPTION OF THE DRAWINGS

In the following detailed description of the invention, reference will be made to the accompanying drawings, incorporated herein by reference, wherein

FIG. 23A shows another side view of yet another embodiment of the present invention;

FIG. 23B shows an exploded view of yet another embodiment of the present invention;

FIG. 26C shows a top view of the pedestal of the present invention;

FIG. 26D shows a side view of the pedestal of the present invention;

FIG. 26E shows a bottom view of the pressure-activated sound-emitting device;

FIG. 26F shows a front view of the pressure-activated sound-emitting device;

FIG. 26G shows a side view of the pressure-activated sound-emitting device;

FIG. 26H shows a perspective side view of the pressure activated sound emitting device;

FIG. 26I shows a top view of the pressure-activated sound emitting device 3.

DETAILED DESCRIPTION OF THE INVENTION

Figure 1:
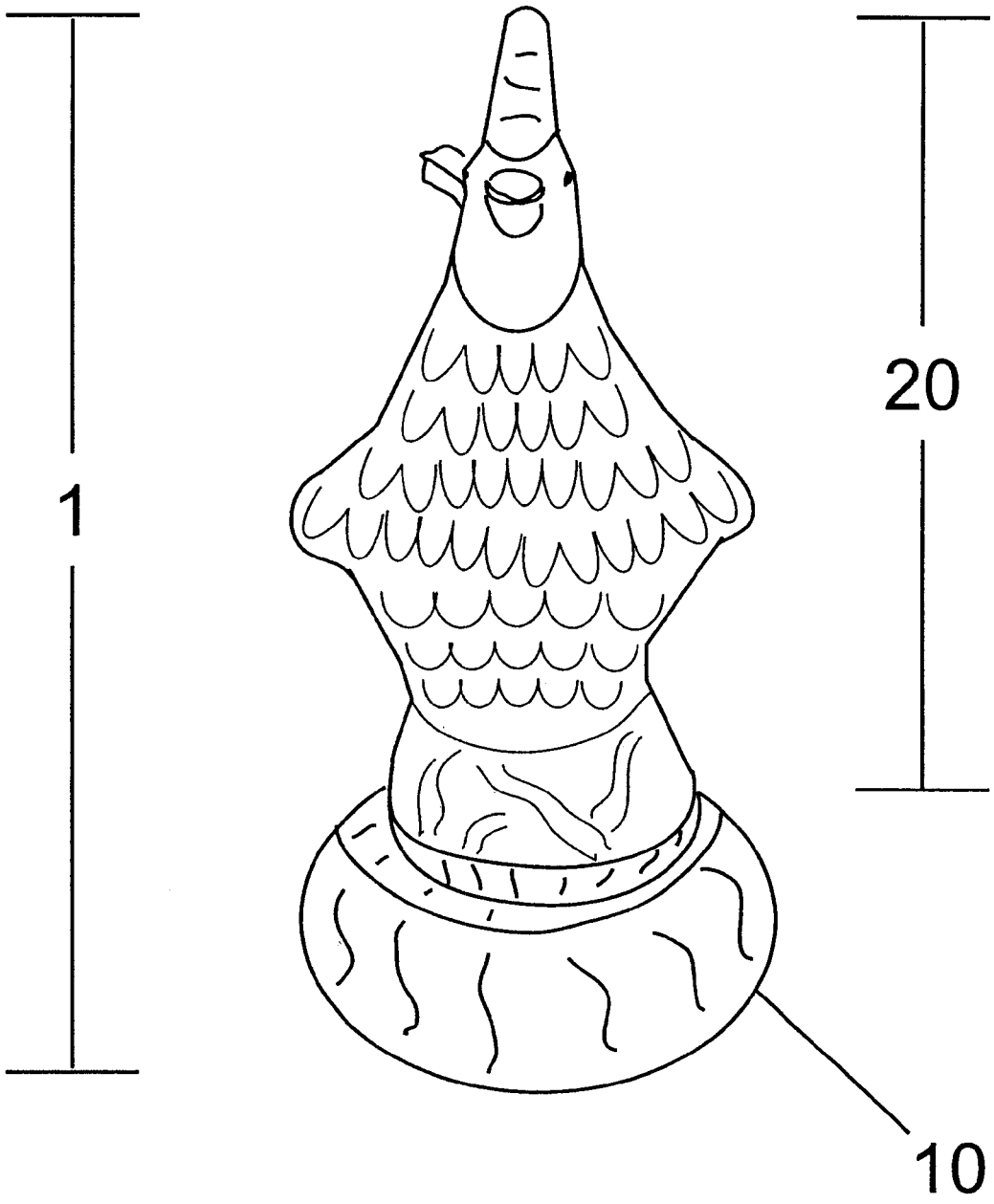
FIG. 1 shows a front view of the sound emitting pump dispenser.
Figure 1A:
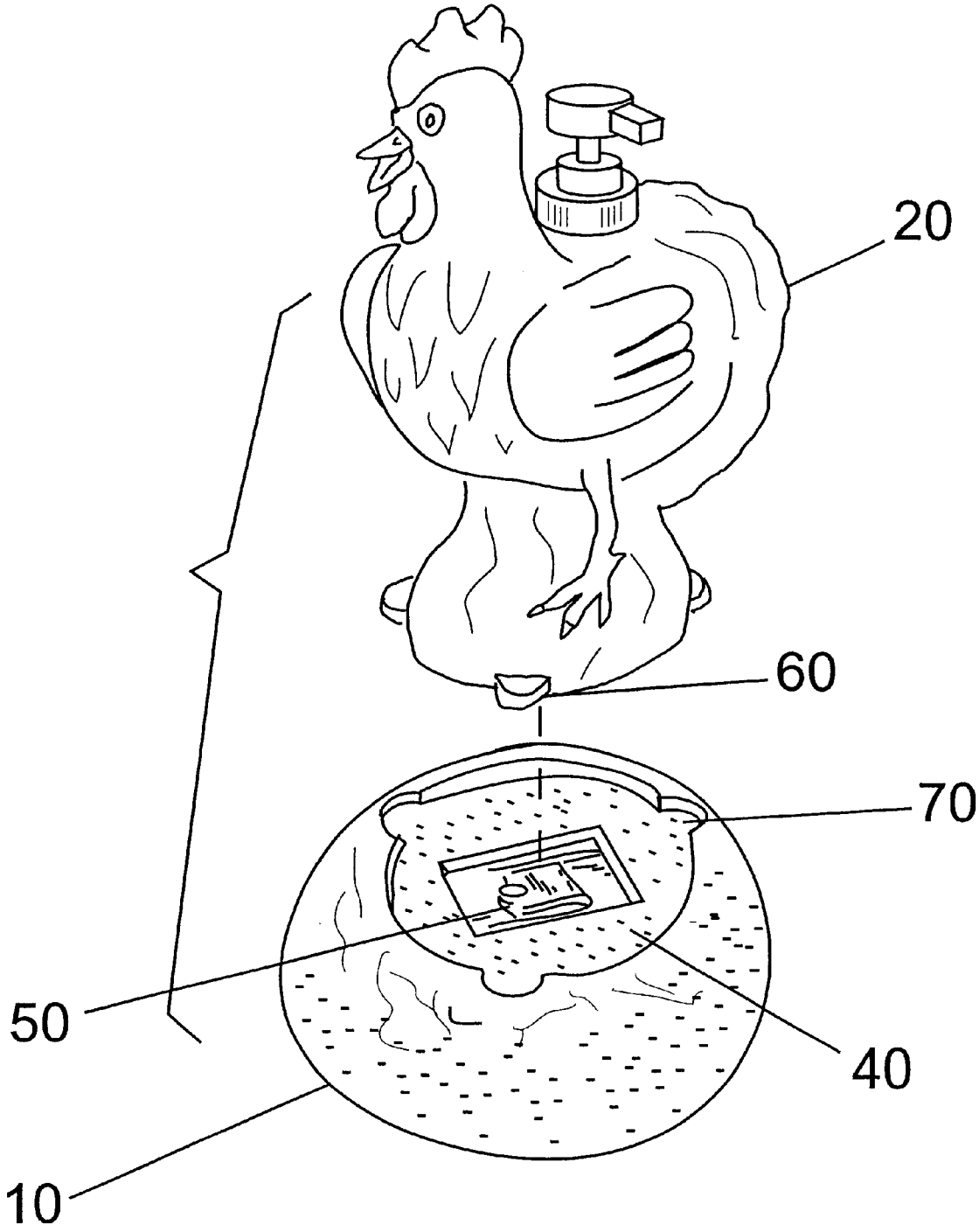
FIG. 1A shows an exploded view of the sound emitting pump dispenser.
Figure 2:
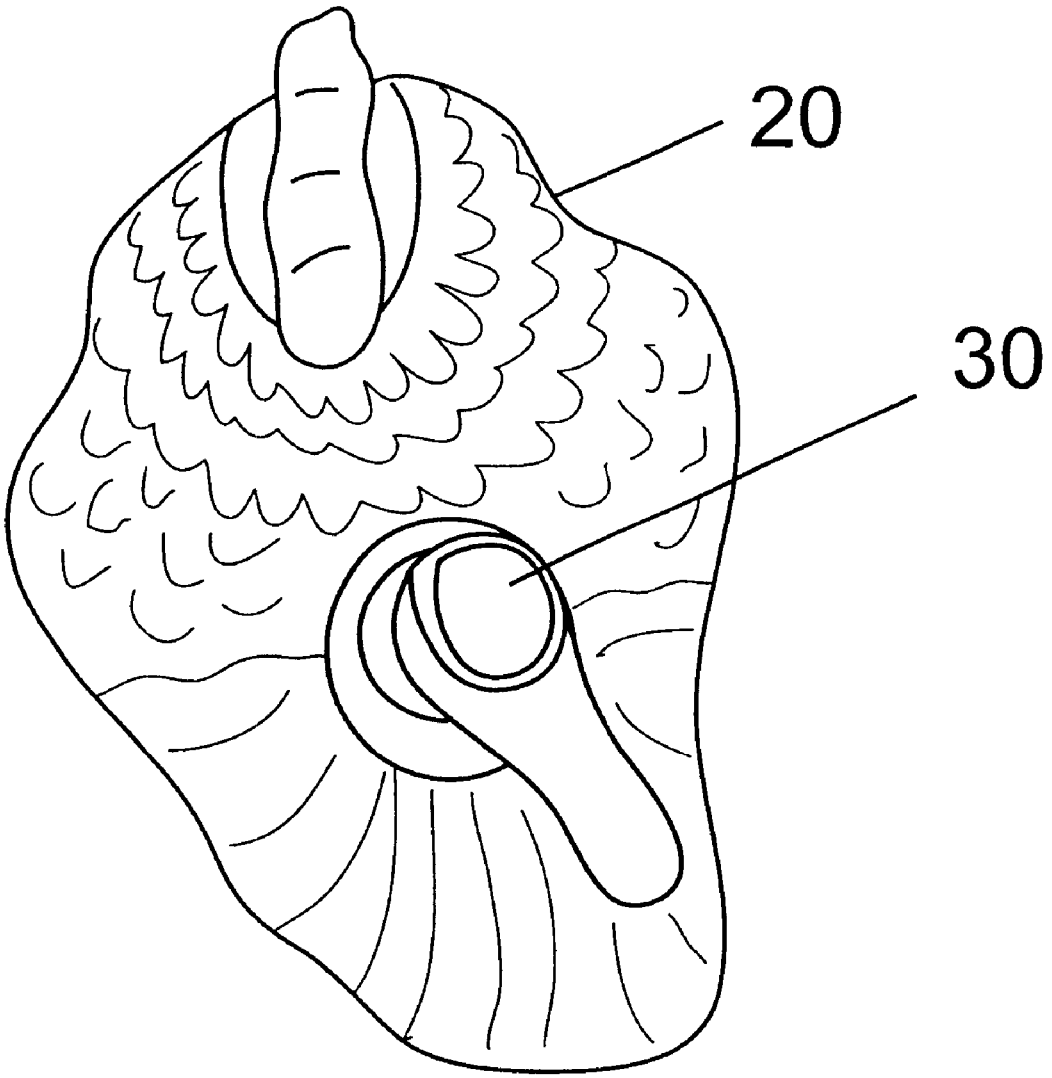
FIG. 2 shows a top rear view of the sound emitting pump dispenser.

Reference is made to all of the Figures herein as preferred embodiments. FIG. 1 shows a sculptured dispenser 20 having a pedestal 10. FIG. 1A shows a sculptured dispenser 20 having male adapters 60 that are matingly fitted with recess 70 in the pedestal when assembled. FIG. 1A also shows a flexible member 40 disposed within pedestal 10 and the flexible member is further in surrounding relationship with the sound-emitting device 50. FIG. 2 shows a top view of the sound emitting pump dispenser having a actuator 30 in order to provide an exit for the liquid contained within the dispenser.

Figure 3:
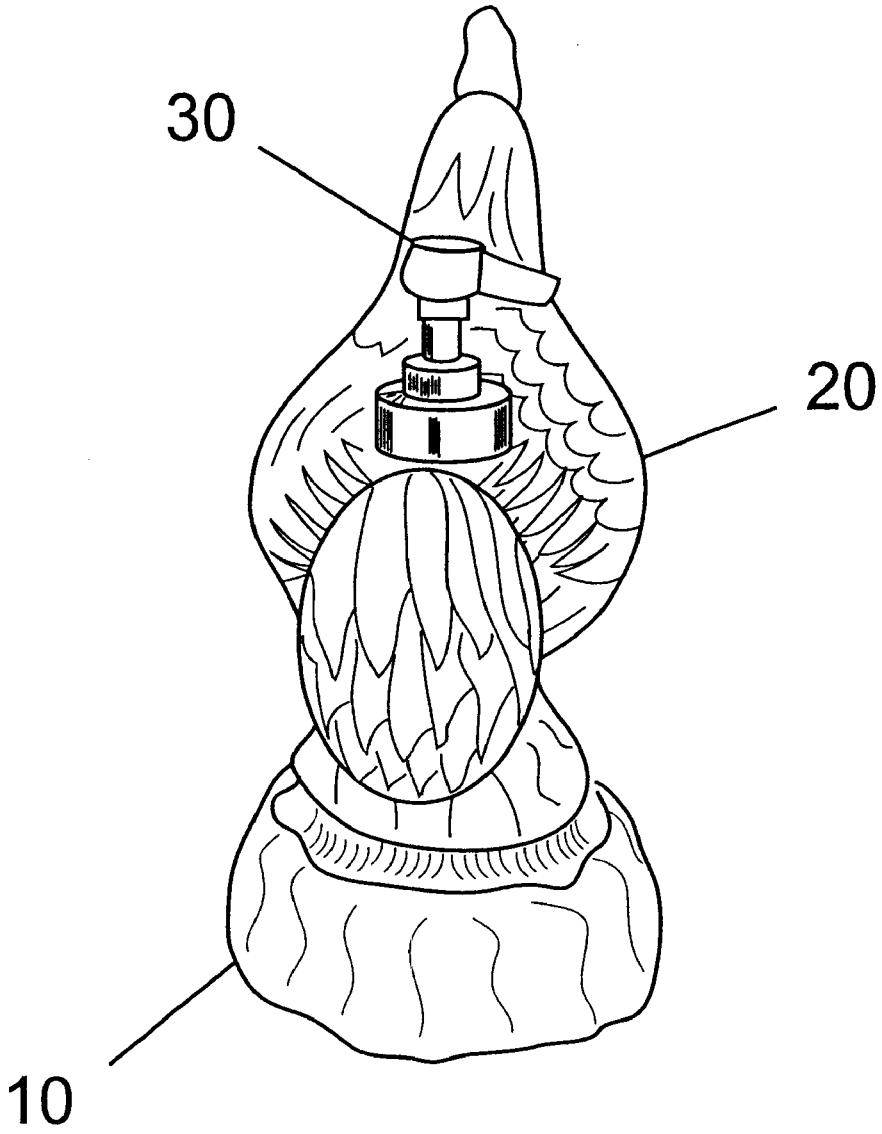
FIG. 3 shows a rear view of the sound emitting pump dispenser.
Figure 4:
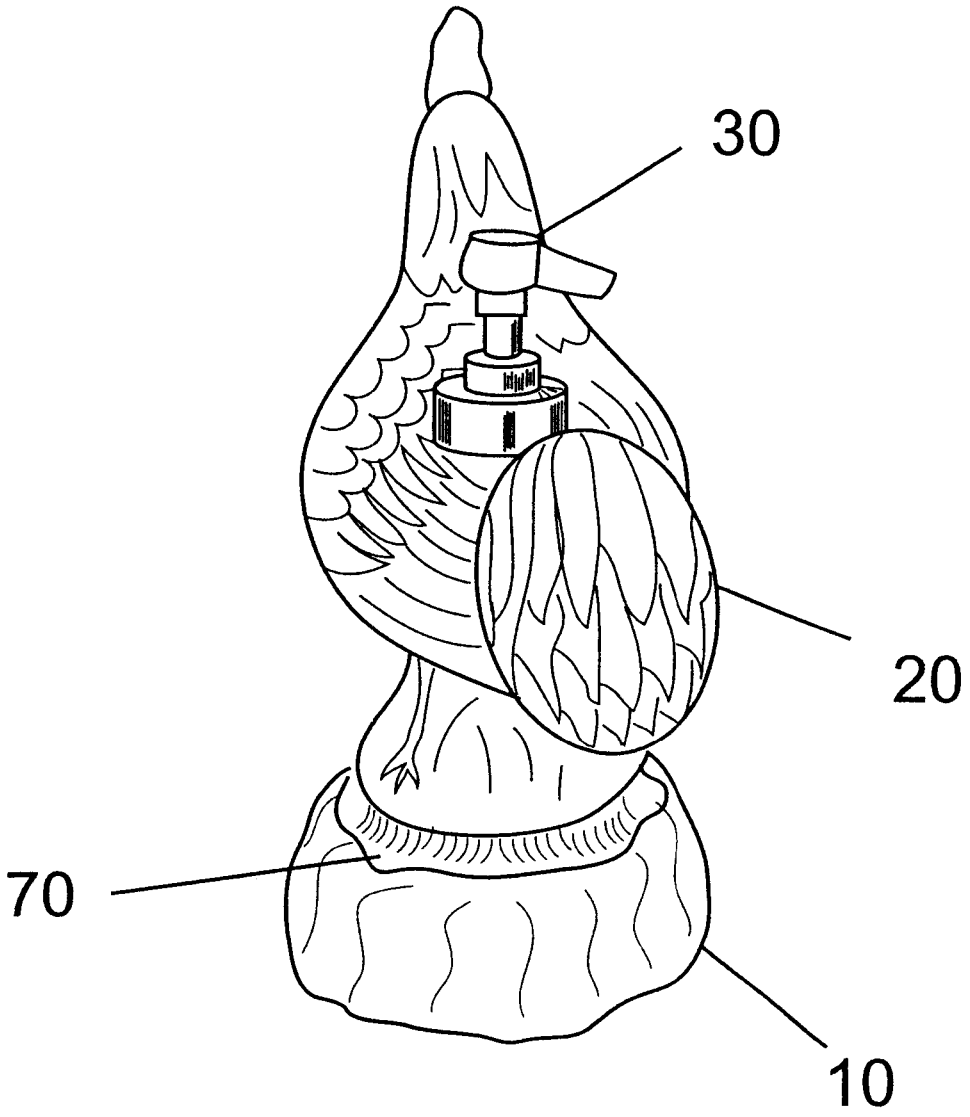
FIG. 4 shows a side view of the sound emitting pump dispenser.

FIG. 3 shows a rear view of the sound emitting pump dispenser having an actuator 30, a sculptured dispenser 20 and a pedestal 10. FIG. 4 shows a side view of the sound emitting pump dispenser having an actuator 30, a pump dispenser 20 and a pedestal 10.

Figure 5:
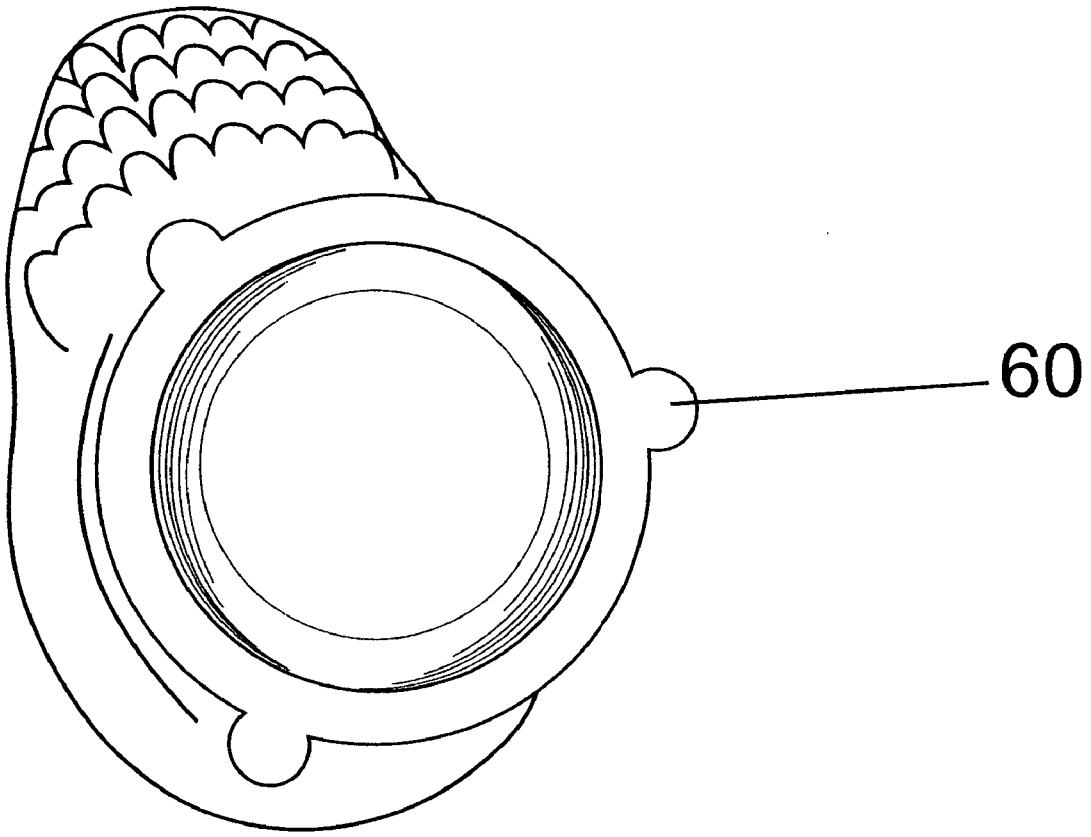
FIG. 5 shows a bottom view of the sound emitting pump dispenser.
Figure 6:
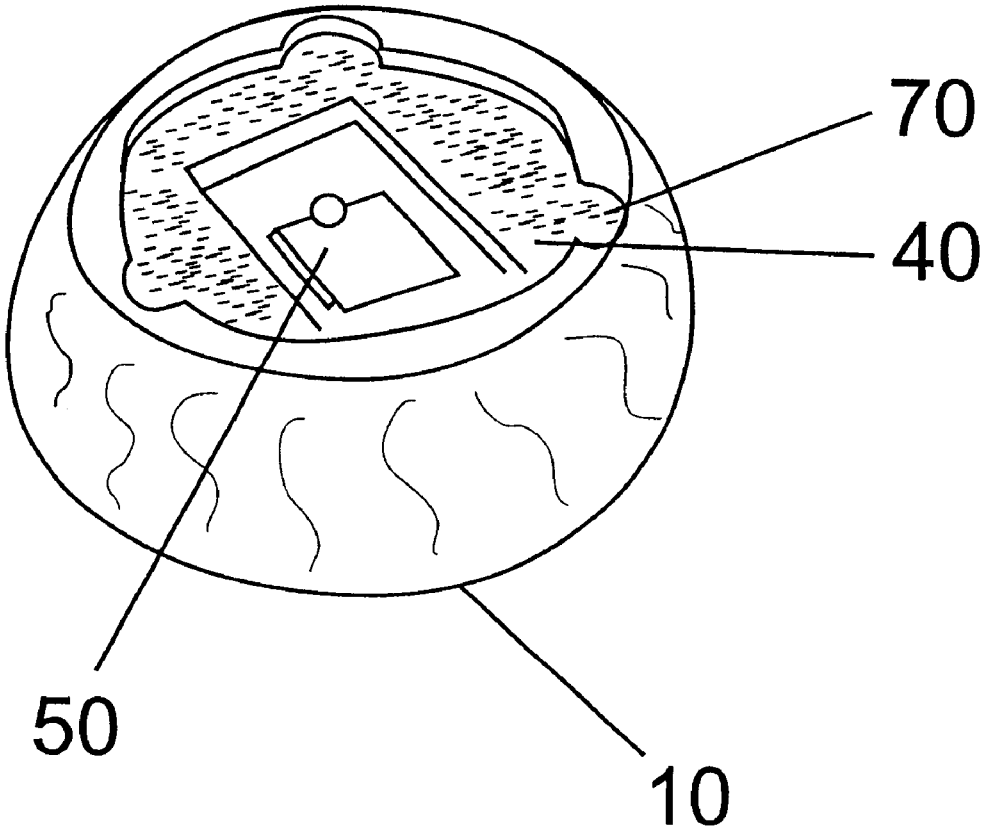
FIG. 6 shows a perspective view of the pedestal.

FIG. 5 shows a bottom view of the sound emitting pump dispenser having three male adapters 60. FIG. 6 shows a perspective view of the pedestal 10 having three recesses 70 (and/or female receptors), a flexible member 40 in surrounding relationship with the pressure activated sound emitting device 50.

Figure 7A:
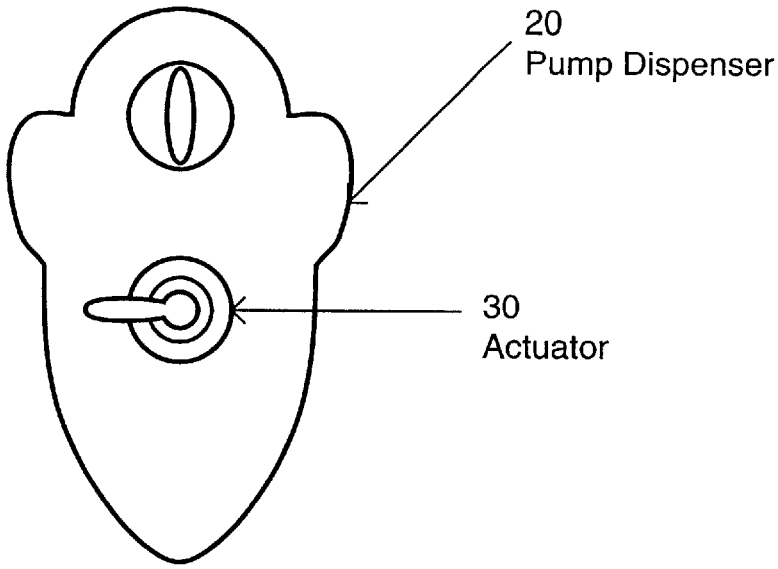
FIG. 7A shows a top view of the dispenser.
Figure 7B:
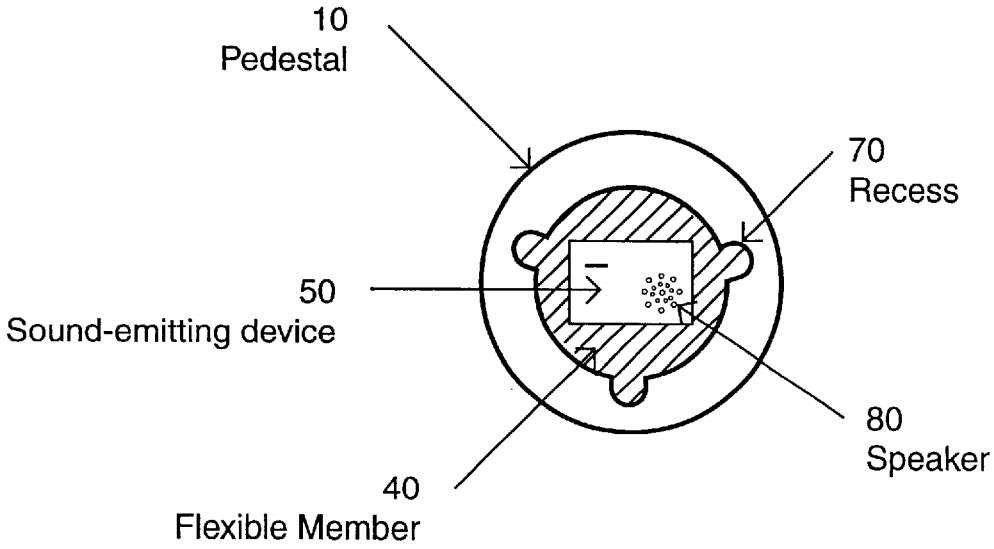
FIG. 7B shows a top view of the pedestal.
Figure 7C:
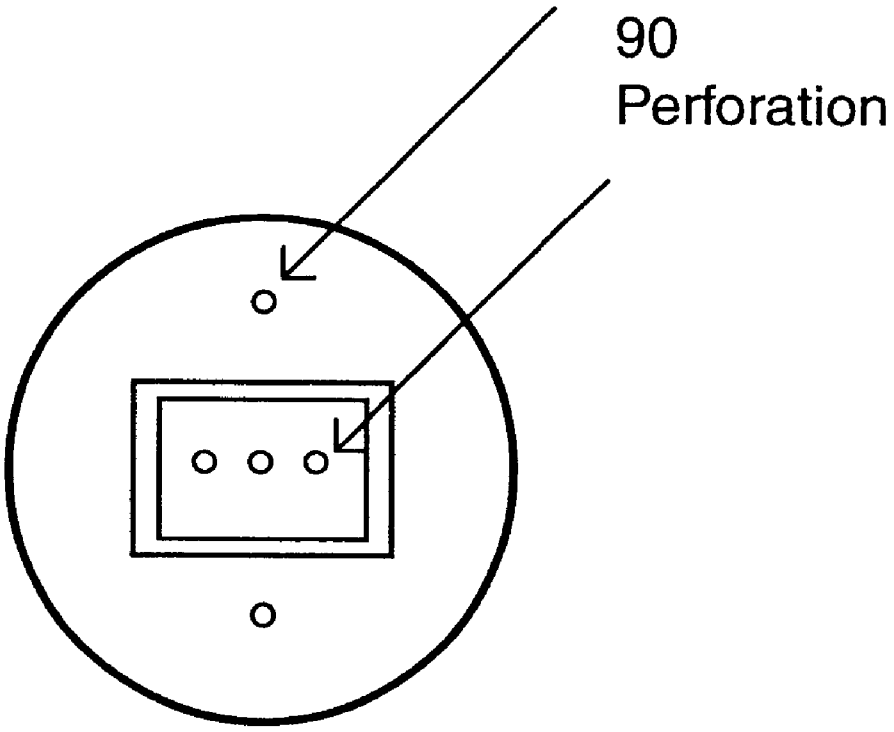
FIG. 7C shows a bottom view of the pedestal having perforations.

FIG. 7A shows a top view of the dispenser having a pump dispenser 20 and an actuator 30. FIG. 7B shows a top view of the pedestal 10 having three recesses 70, a flexible member 40 and a pressure activated sound emitting device. FIG. 7C shows perforations on the bottom of the pedestal 10 which provides draining for excess liquid as well as for volume control.

Figure 8:
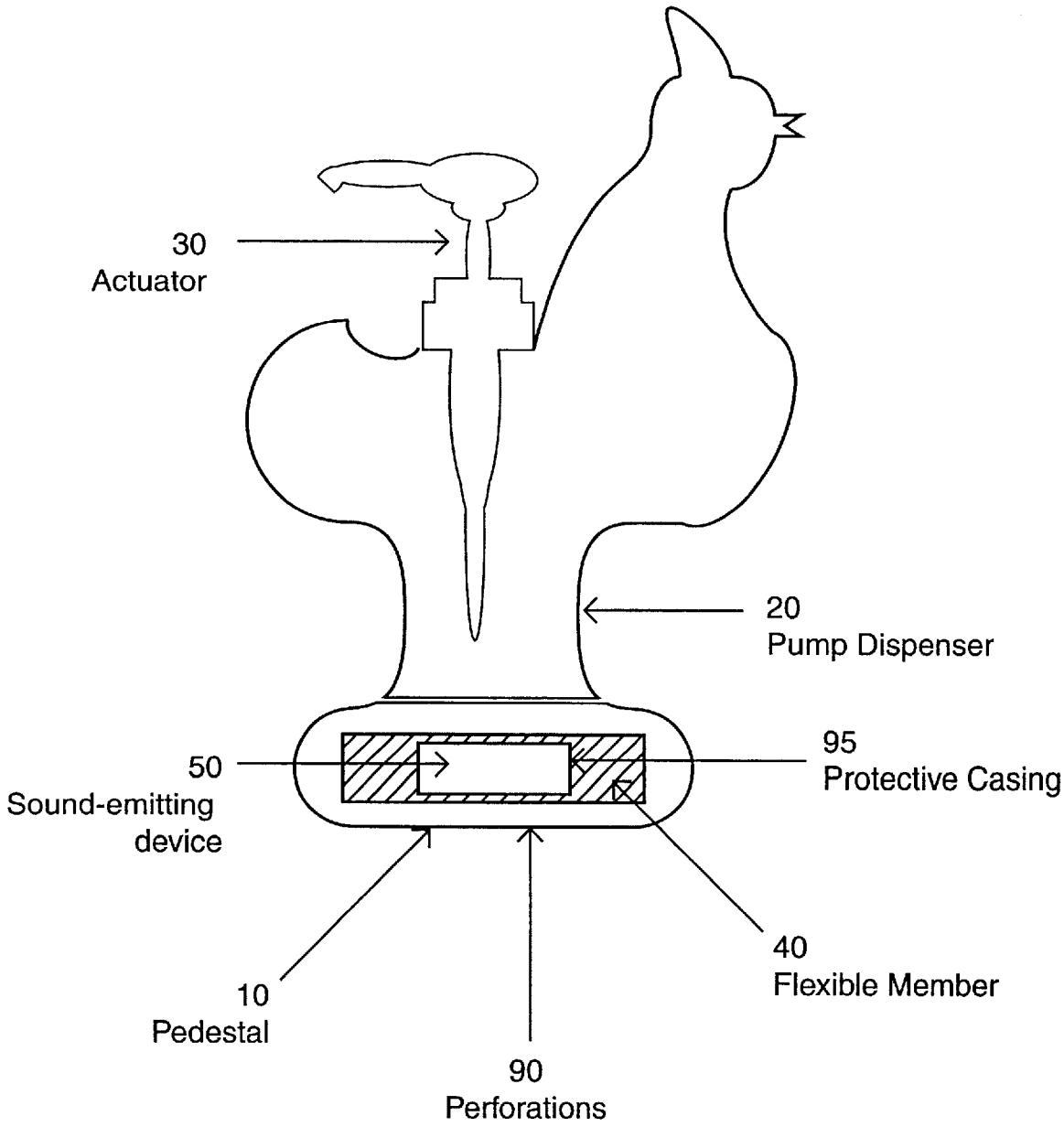
FIG. 8 shows a side view of the sound emitting pump dispenser.
Figure 8A:
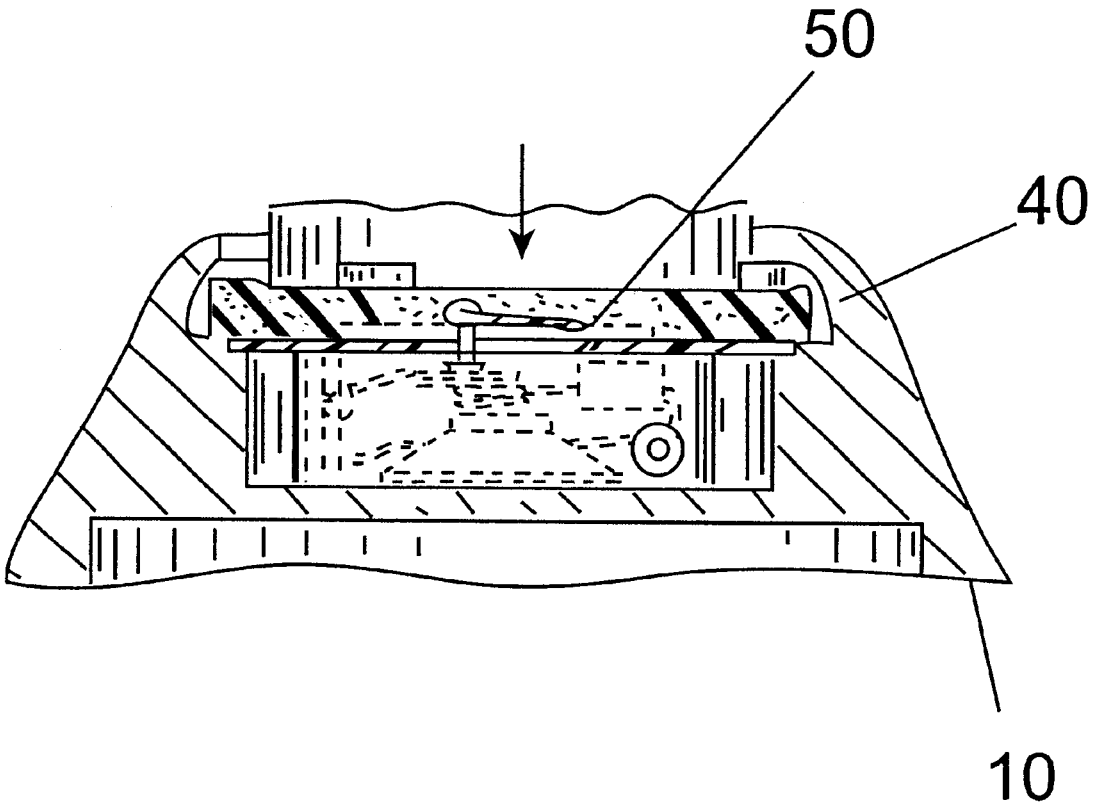
FIG. 8A shows a cross sectional view of the pedestal.
Figure 9:
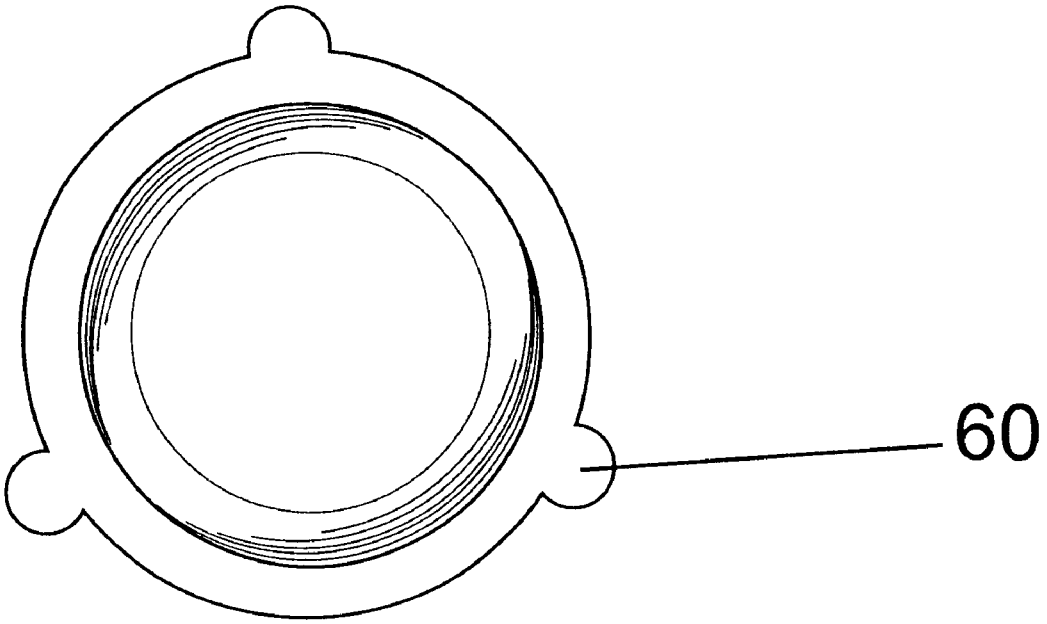
FIG. 9 shows a bottom view of the pump dispenser.
Figure 10:
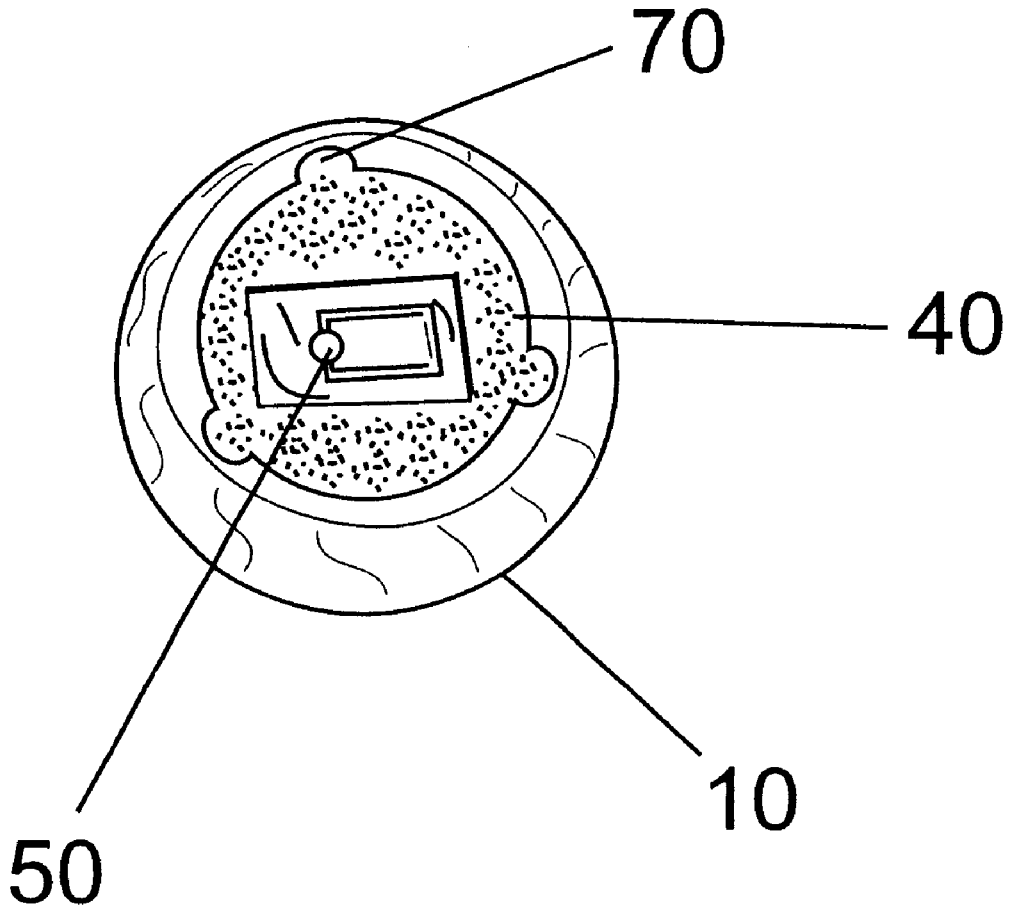
FIG. 10 shows a top view of the pedestal.

FIG. 8 shows a side view of the sound emitting pump dispenser having a pump dispenser 20, a flexible member 40 in surrounding relationship with the pressure activated sound emitting device 50 and an actuator 30. FIG. 8A shows a cross-sectional view of the pedestal 10 having flexible member 40 in surrounding relationship with the sound emitting device 50. FIG. 9 shows a bottom view of the pump dispenser 20 having three male adapters 60. FIG. 10 shows a pedestal 10 having three recesses 70 in order to receive the male adapters 60 of the pump dispenser and matingly fitted the pedestal to the pump dispenser.

Figure 11:
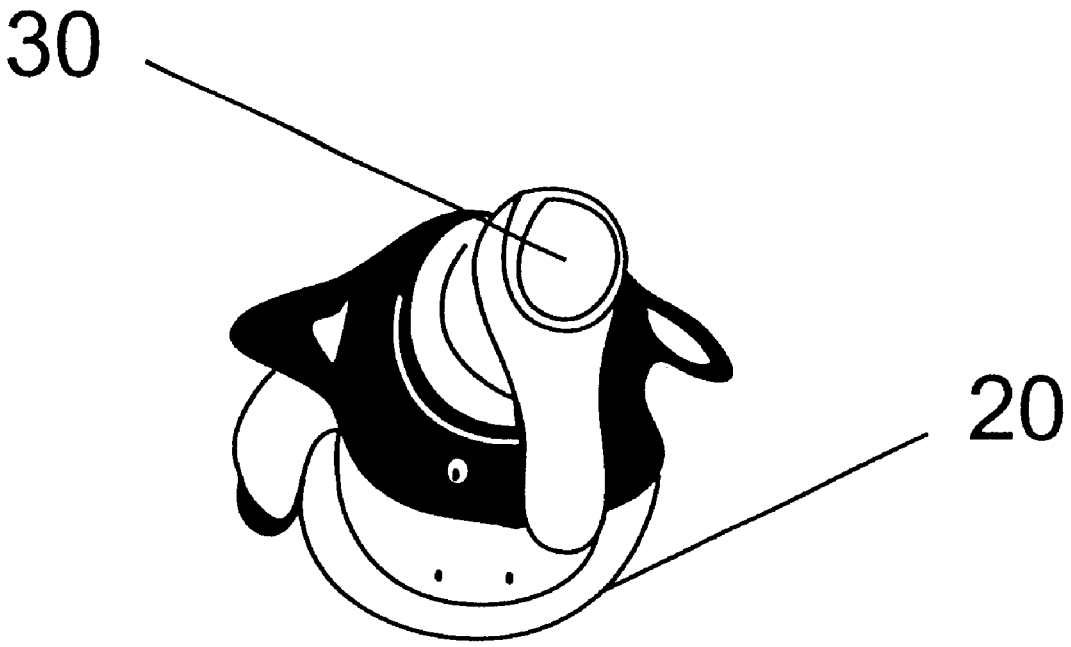
FIG. 11 shows a top perspective view of another embodiment of the present invention.
Figure 12:
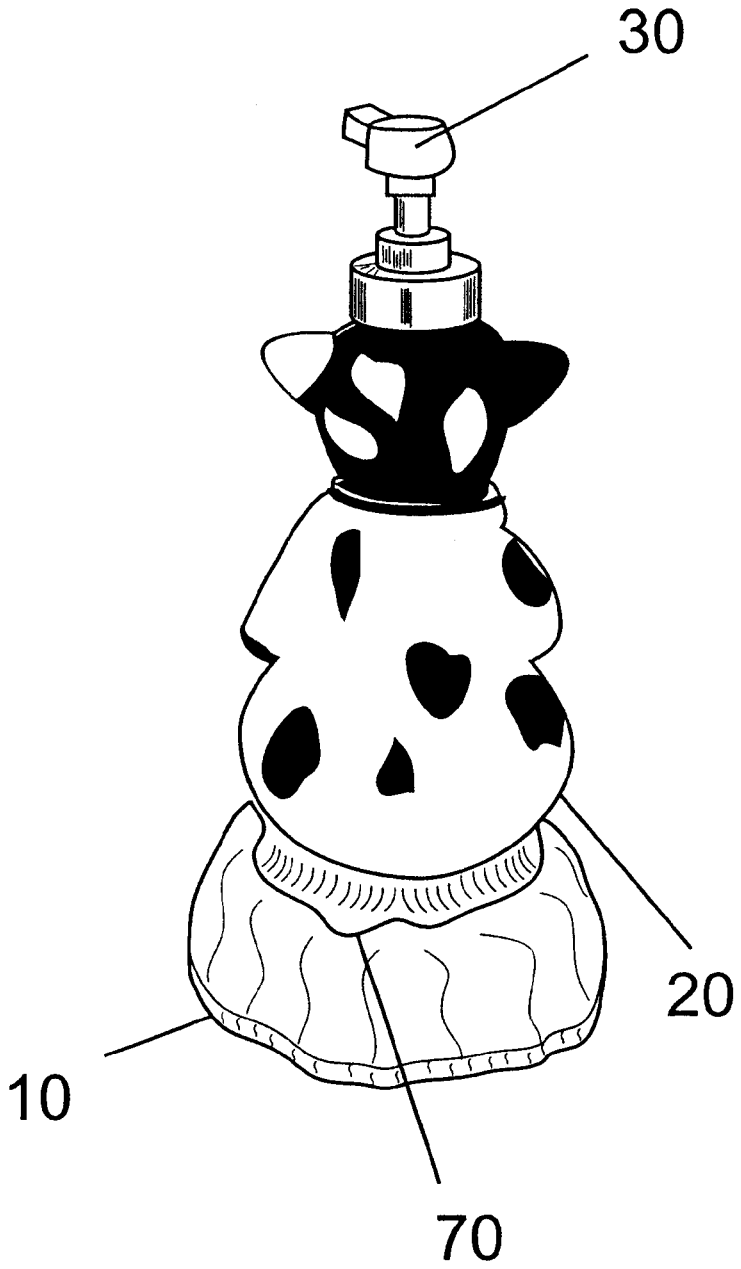
FIG. 12 shows a rear view of another embodiment of the present invention.
Figure 13:
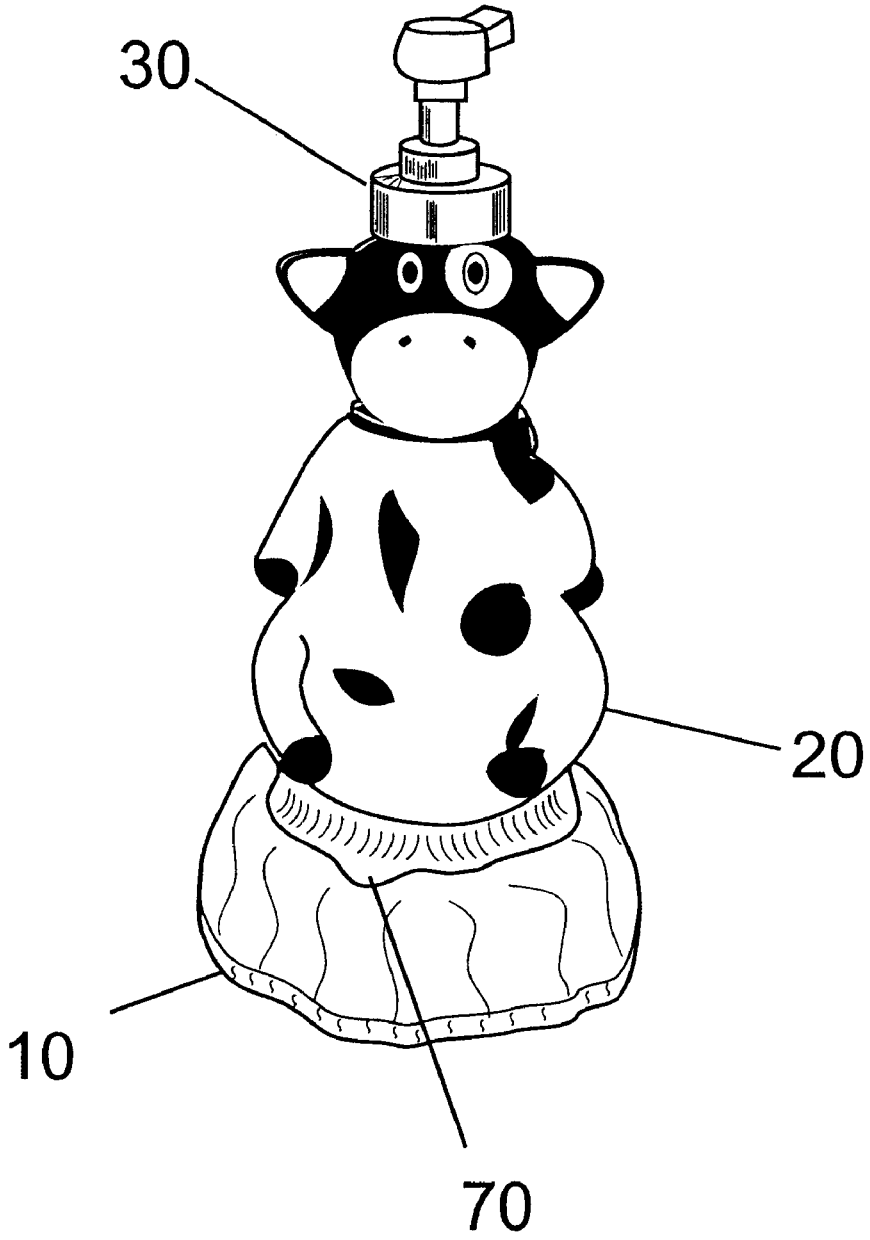
FIG. 13 shows a front view of another embodiment of the present invention.

FIG. 11 shows a top perspective view of another embodiment of the invention (hand not included) having an actuator 30 and a pump dispenser 20. FIG. 12 shows an actuator 30, a pump dispenser 20 and a pedestal 10 that are matingly fitted to the pump dispenser. FIG. 13 shows a front view of another embodiment of the present invention having an actuator 30, a pump dispenser 20 and a pedestal 10 mating fitted to the pump dispenser 20 wherein the recesses 70 of the pedestal 10 can be seen in this drawing.

Figure 14:
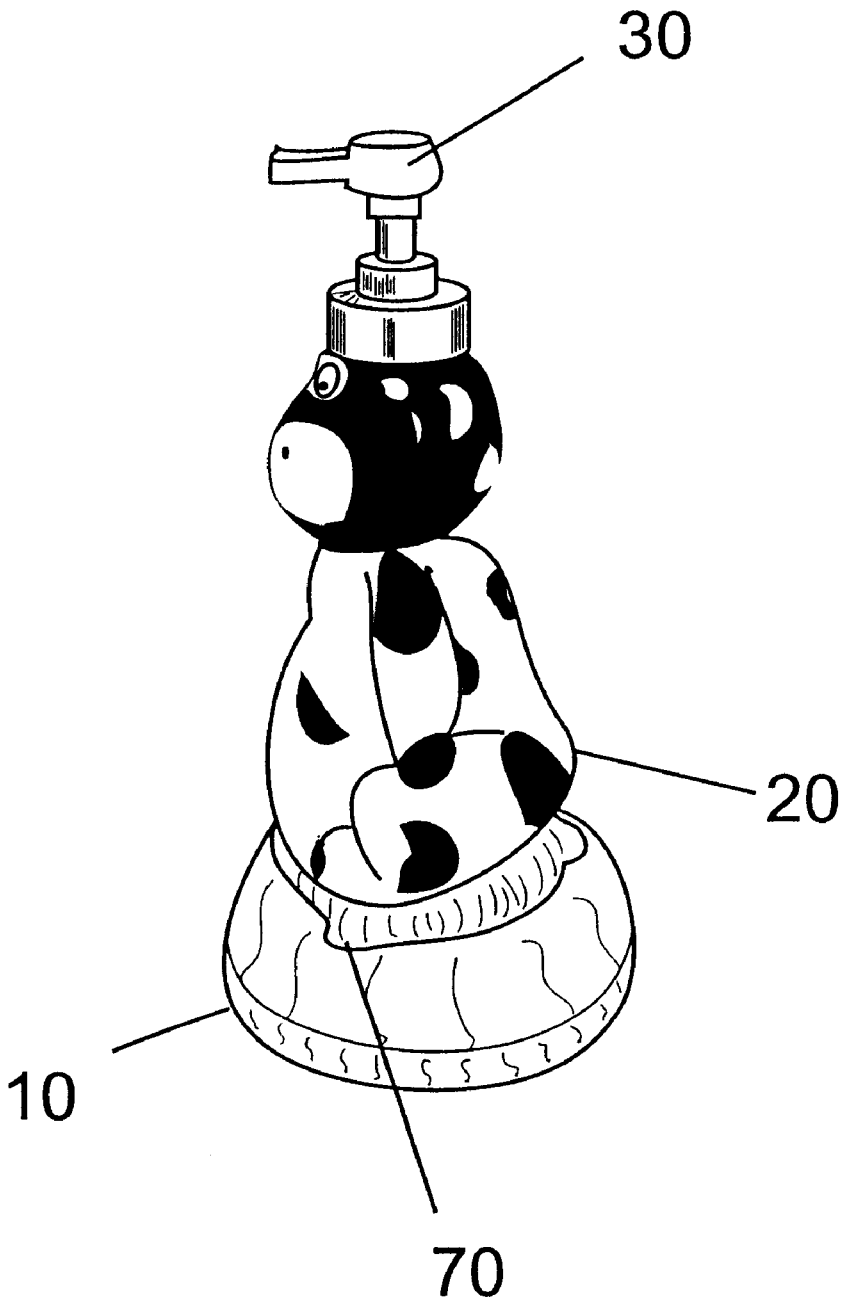
FIG. 14 shows a side view of another embodiment of the present invention.
Figure 15:
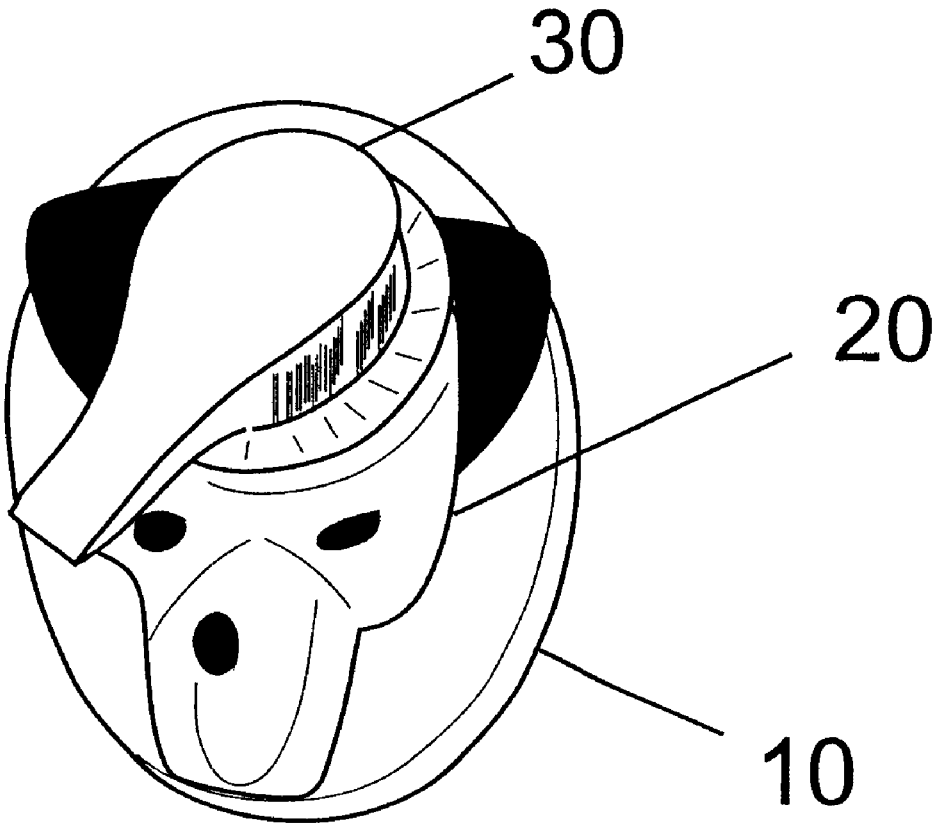
FIG. 15 shows a top view of a further embodiment of the present invention.
Figure 16:
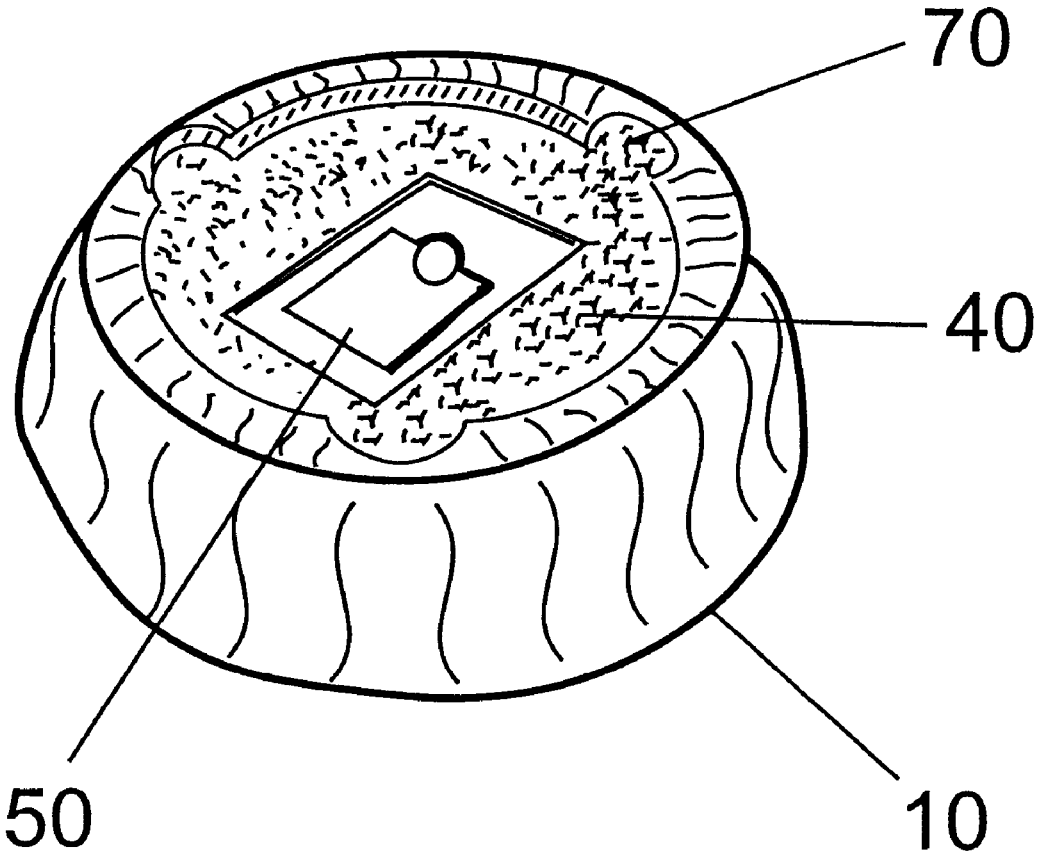
FIG. 16 shows a top perspective view of the pedestal of a further embodiment of the present invention.
Figure 17:
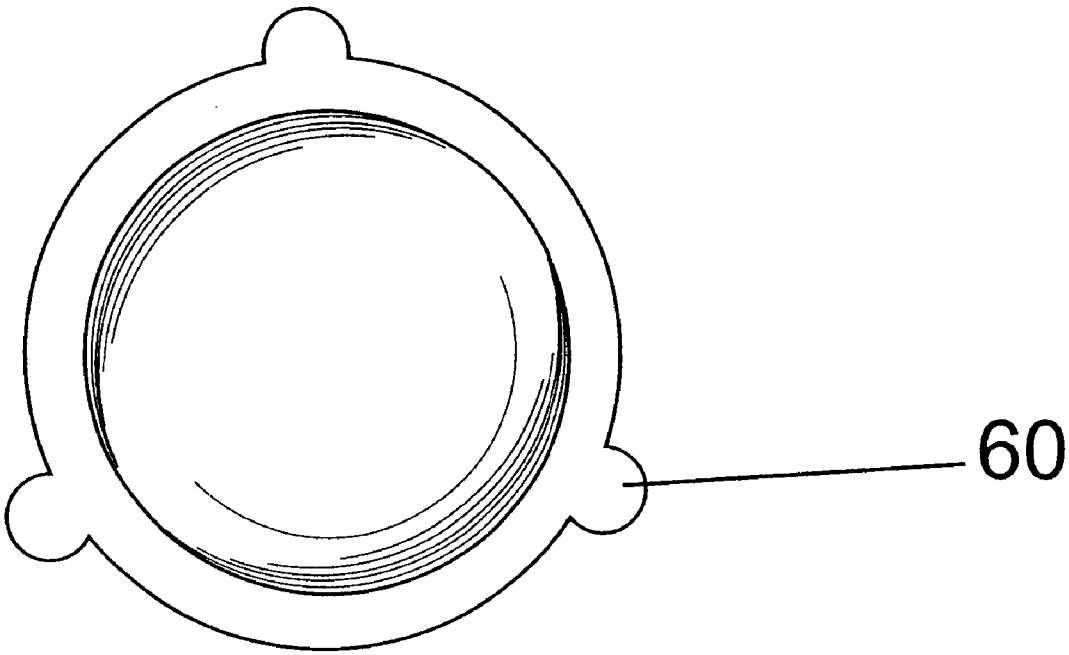
FIG. 17 shows a bottom view of the pump dispenser showing three male adapters.

FIG. 14 shows a side view of another embodiment of the present invention having an actuator 30, a pump dispenser 20, a pedestal 10 and one recess 70 on top of the pedestal 10. FIG. 15 shows a top view of a further embodiment of the invention having an actuator 30 and a pump dispenser 20. FIG. 16 shows a pedestal 10 having three recesses 70, a flexible member 40 in surrounding relationship with a pressure activated sound emitting device 50. FIG. 17 shows a bottom view of the pump dispenser 20 having three protrusions and/or male adapters 60.

Figure 18:
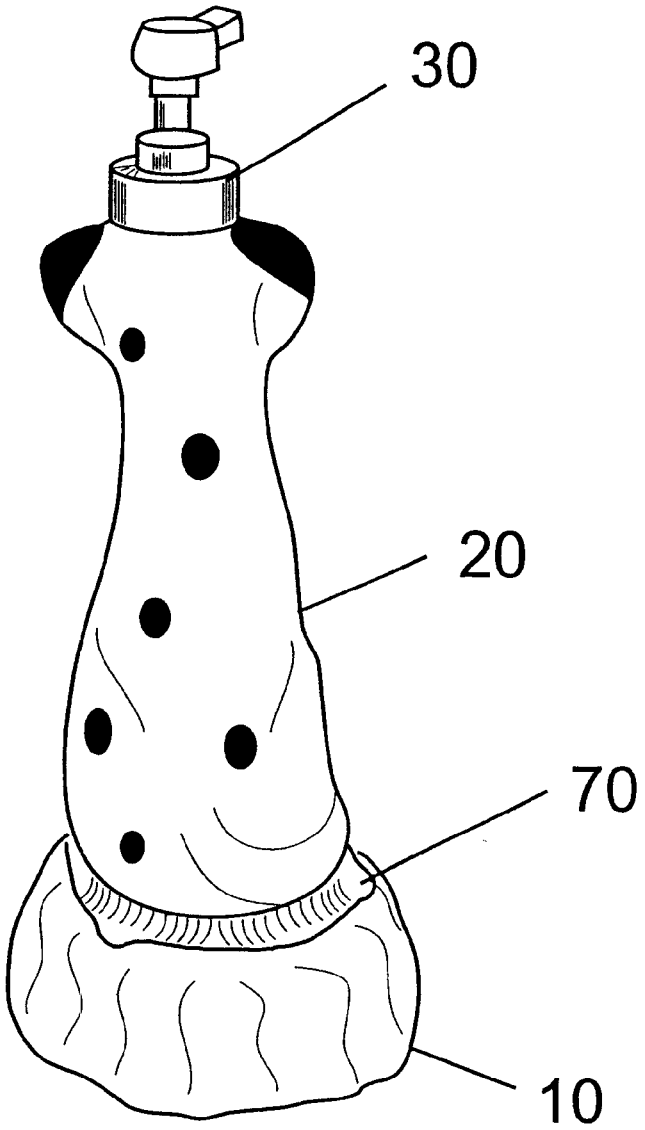
FIG. 18 shows a rear view of the further embodiment of the present invention.
Figure 19:
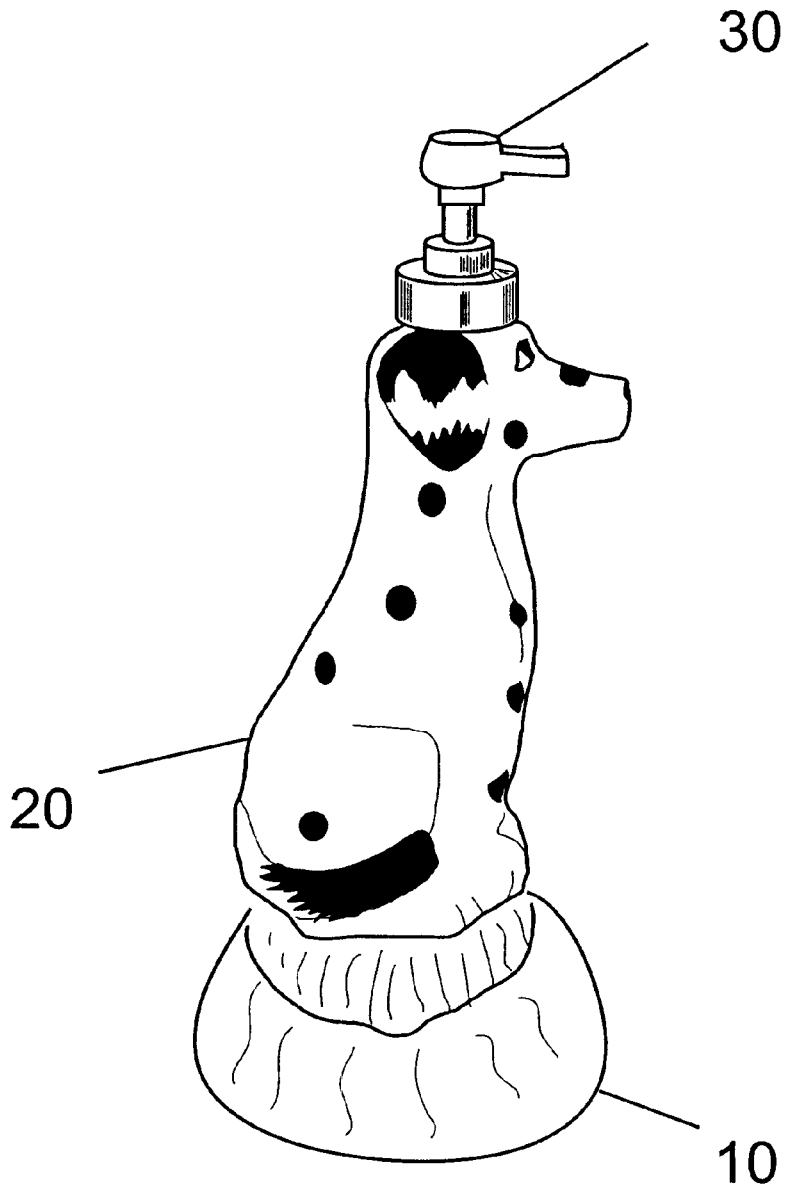
FIG. 19 shows a side view of the further embodiment of the present invention.
Figure 19A:
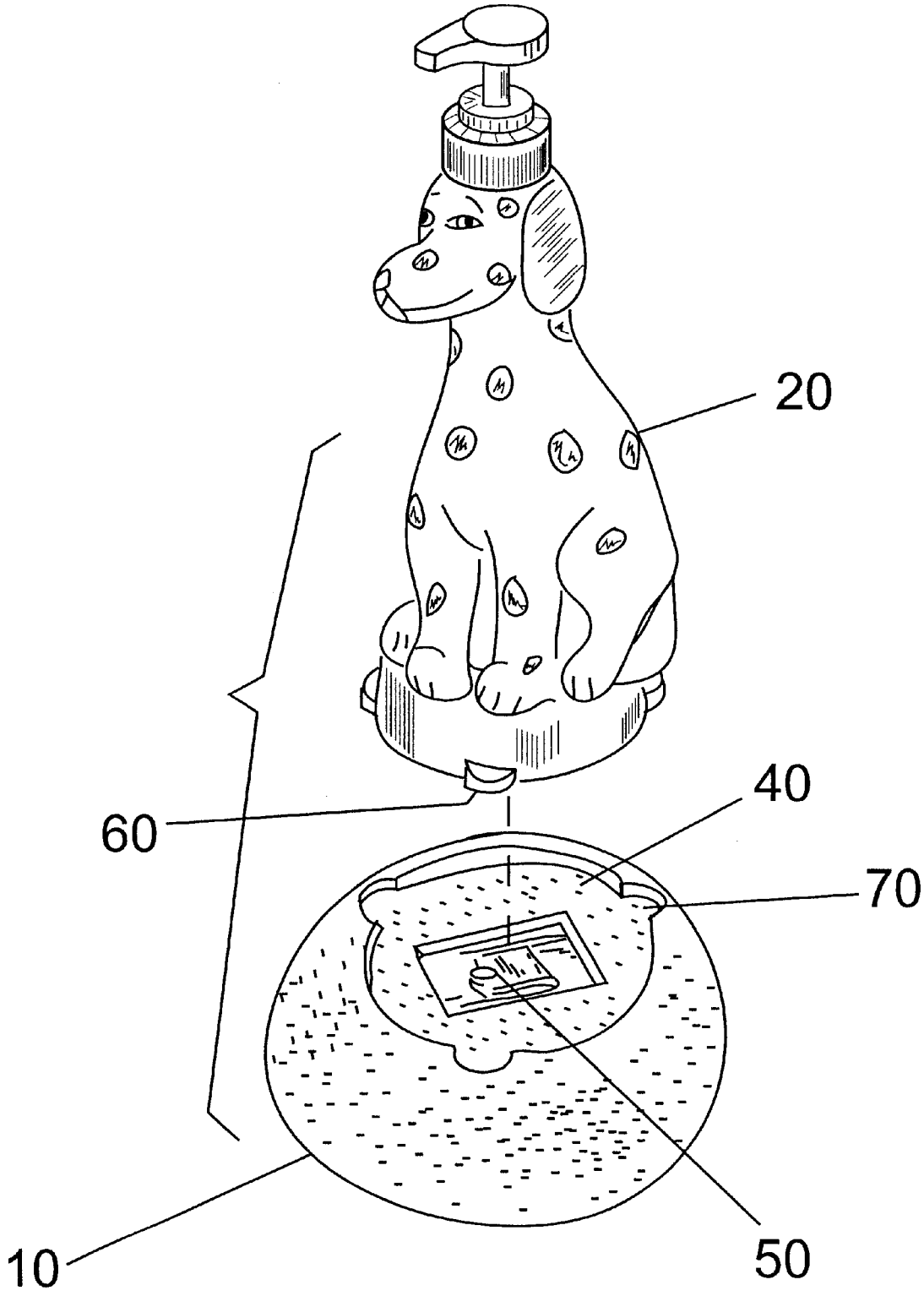
FIG. 19A shows an exploded view of the further embodiment of the present invention.
Figure 20:
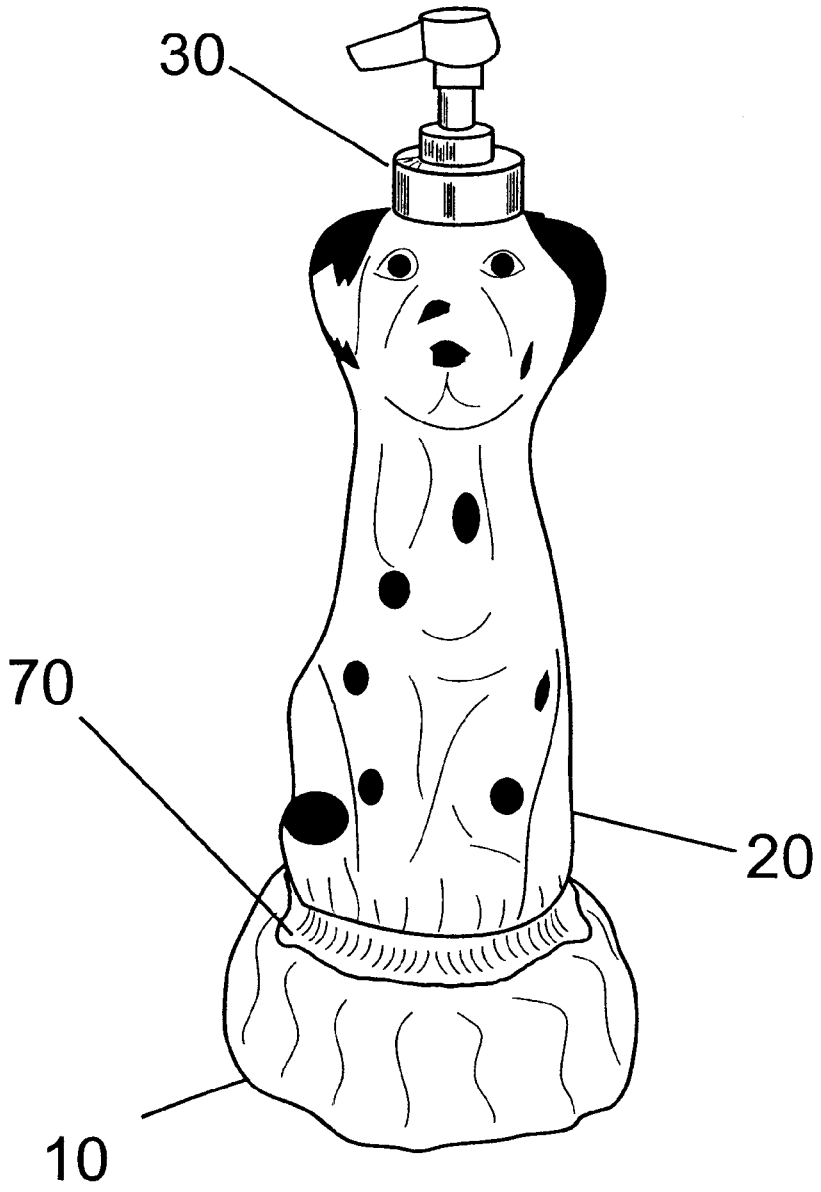
FIG. 20 shows a front view of the further embodiment of the present invention.
Figure 21:
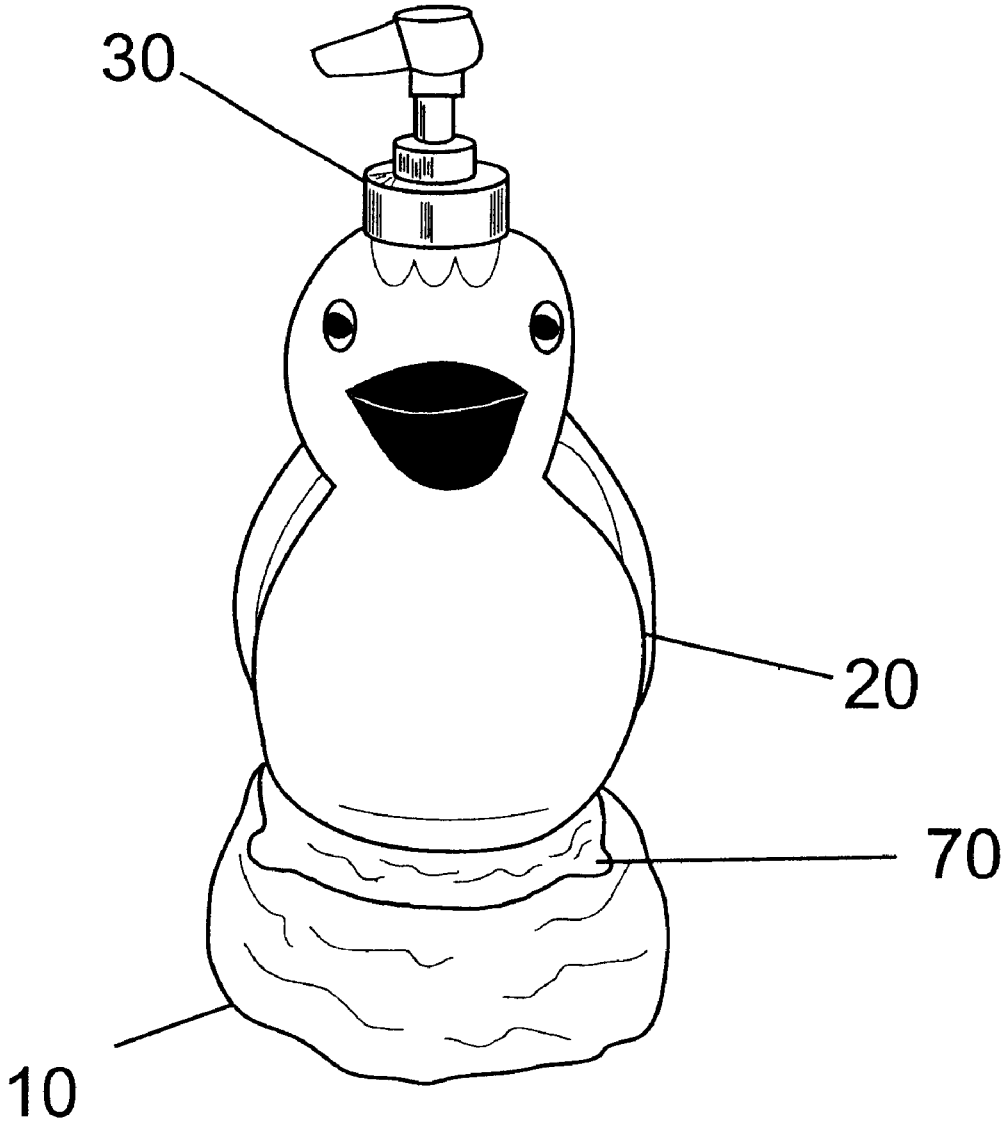
FIG. 21 shows a front view of yet another embodiment of the present invention.
Figure 22:
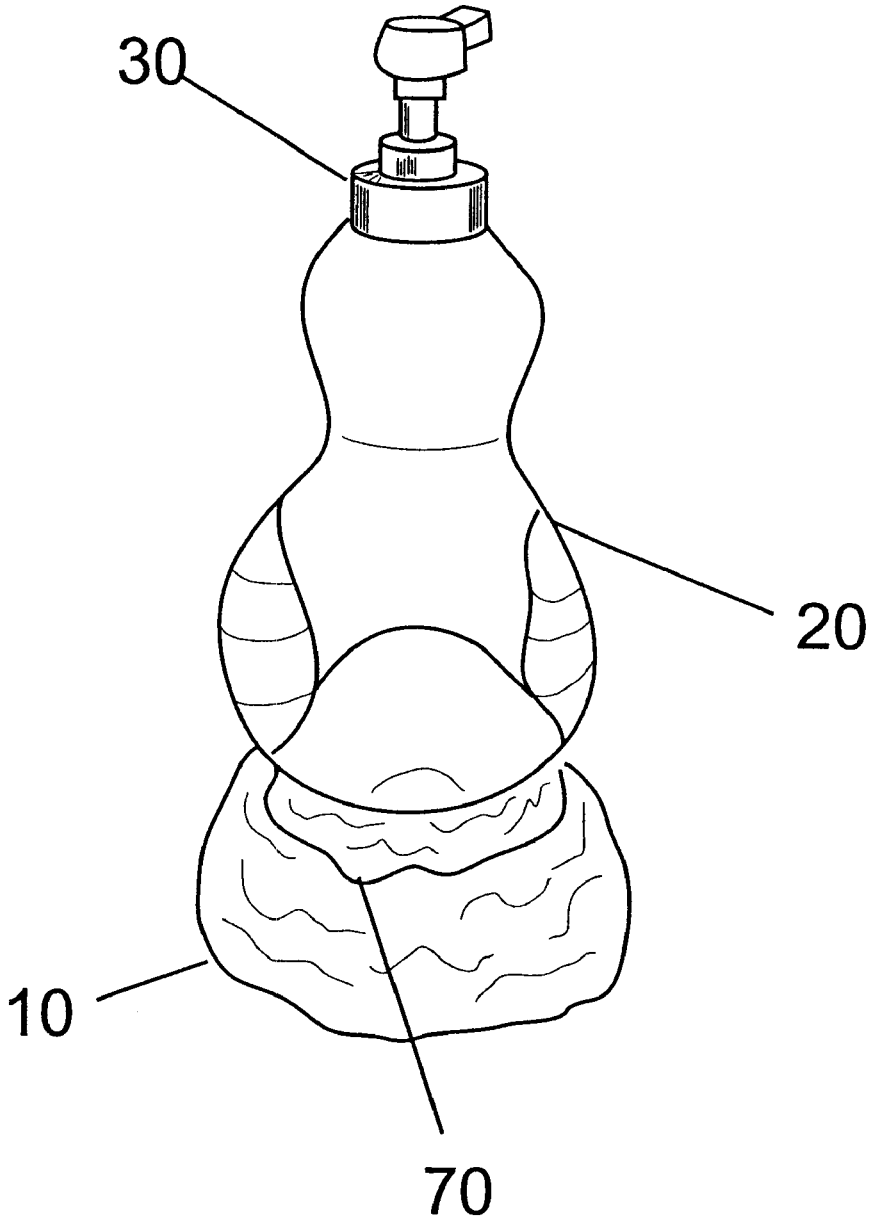
FIG. 22 shows a rear view of yet another embodiment of the present invention.

FIG. 18 shows a rear view of the further embodiment of the present invention having a pump dispenser 20, a pedestal 10 and an actuator 30. FIG. 19 shows a side view of the further embodiment of the present invention having an actuator 30, a pump dispenser 20 and a pedestal 10. FIG. 19A shows an exploded view of the further embodiment of the present invention having a pump dispenser 20, the pump dispenser further having male adapters 60 which matingly-fitted with recess 70 of the pedestal when the present invention is assembled. The pedestal 10 further comprises a flexible member 40, a sound-emitting device 50. FIG. 20 shows a front view of the further embodiment of the invention having an actuator 30, a pump dispenser 20 and a pedestal 10. FIG. 21 shows a front view of yet another embodiment of the present invention wherein the pump dispenser 20 could be sculptured to give the appearance of a duck, an actuator 30 and a pedestal 10. FIG. 22 shows a rear view of yet another embodiment of the invention having an actuator 30, a pump dispenser 20 in the shape of a duck and a pedestal 10.

Figure 23:
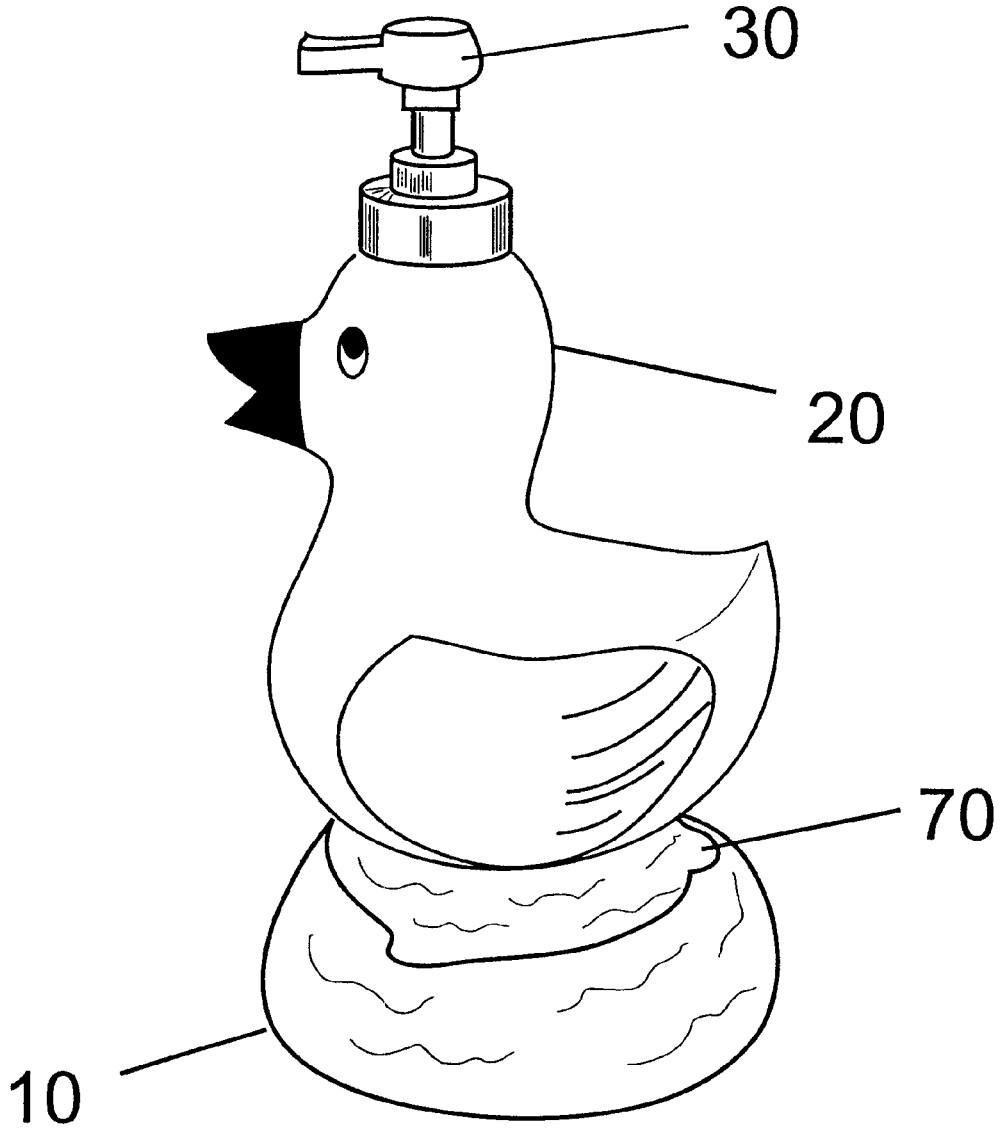
FIG. 23 shows a side view of yet another embodiment of the present invention.
Figure 24:
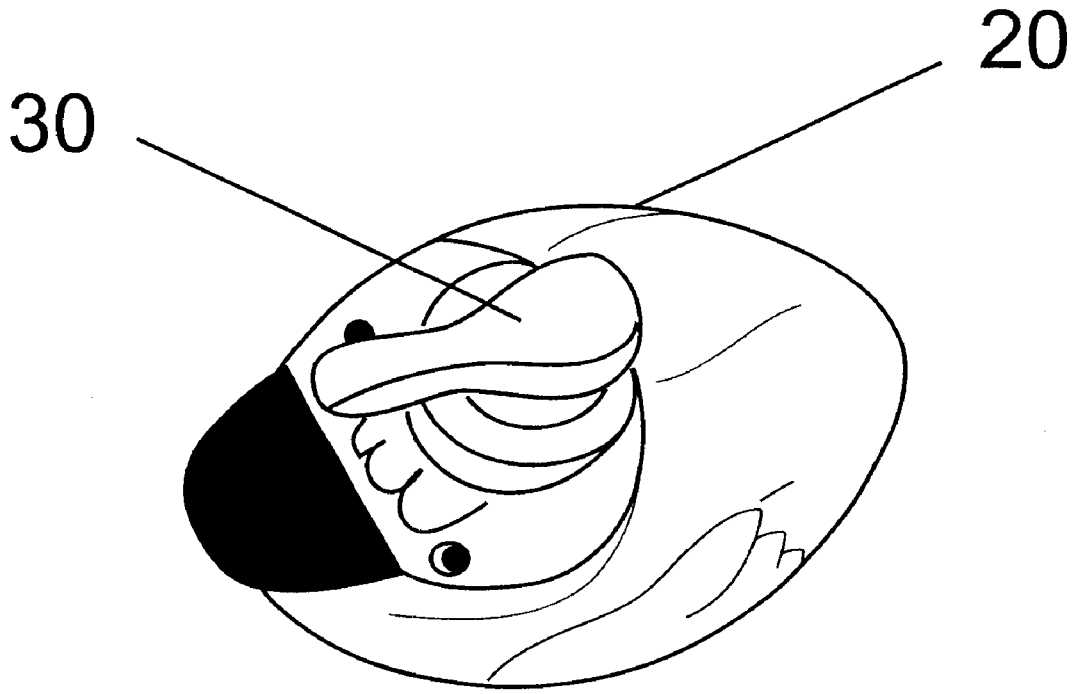
FIG. 24 shows a top view of yet another embodiment of the present invention.
Figure 25:
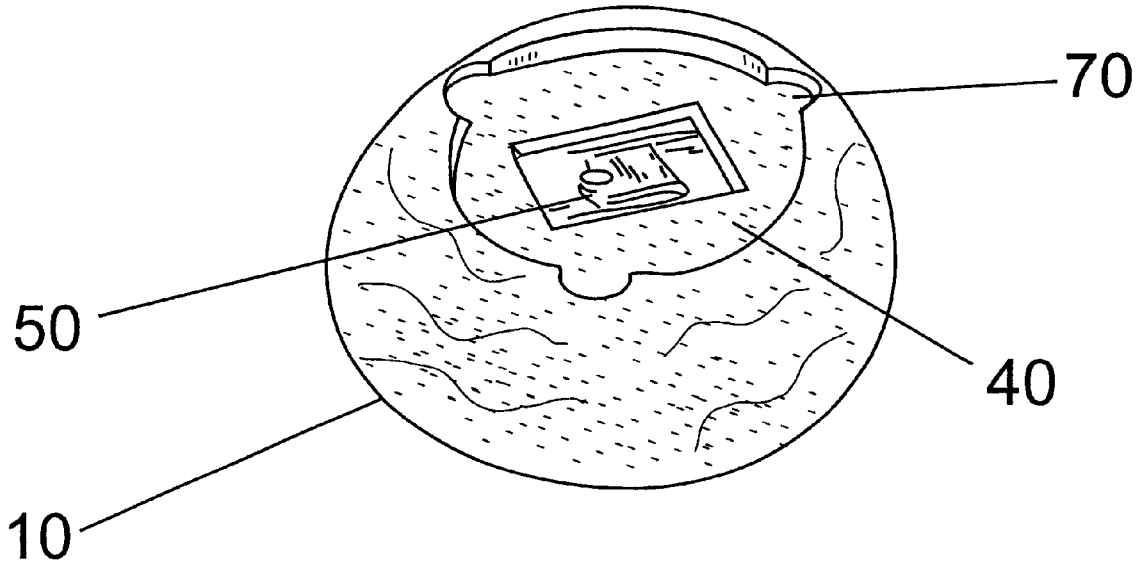
FIG. 25 shows a top view of the pedestal of the present invention.

FIG. 23 shows a side view of yet another embodiment of the invention having an actuator 30, a pump dispenser 20 in the shape of a duck and a pedestal 10 which have recesses 70 to receive the male adapters 60 (not shown). FIG. 23 shows another side view of yet another embodiment of the present invention. FIG. 23B shows an exploded view of yet another embodiment of the present invention having a pump dispenser 20, at least one male adapter 60 that are matingly fitted with the recess 70 of the pedestal 10, the pedestal 10 further comprising a flexible member 40 in surrounding relationship with the sound emitting device 50. FIG. 24 shows a top view of yet another embodiment of the present invention having an actuator 30 and a pump dispenser that resembles a duck (hand is not included). FIG. 25 shows a top view of the pedestal 10 having three recesses 70, a flexible member 40 in surrounding position with the pressure activated sound emitting device 50.

Figure 26A:
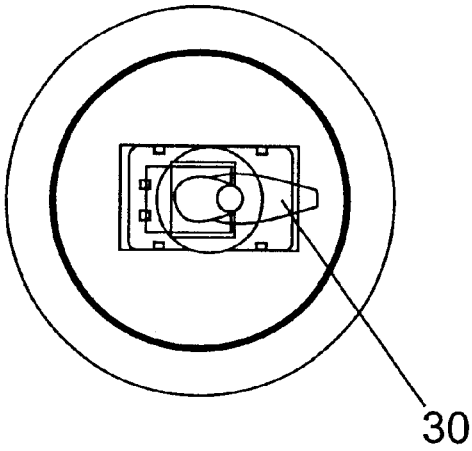
FIG. 26A shows a top view of the sound emitting liquid dispenser of the present invention.
Figure 26B:
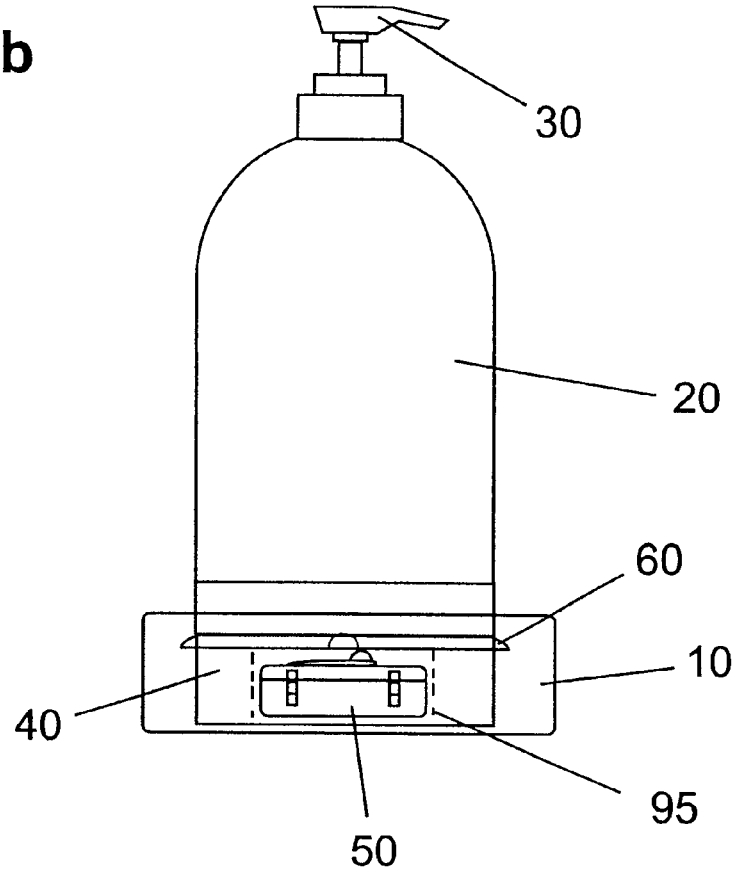
FIG. 26B shows a side cross-sectional view of the sound emitting liquid dispenser of the present invention.

FIG. 26A shows a top view of the sound emitting liquid dispenser having an actuator 30. FIG. 26B shows a side cross-sectional view of the sound emitting liquid dispenser having an actuator 30, a pump dispenser 20, a pedestal 10 containing a flexible member 40 and a pressure activated sound emitting device 50. FIG. 26C shows a top perspective view of the flexible member 40. FIG. 26D shows a front cross-sectional view of the flexible member 40.

Figure 27:
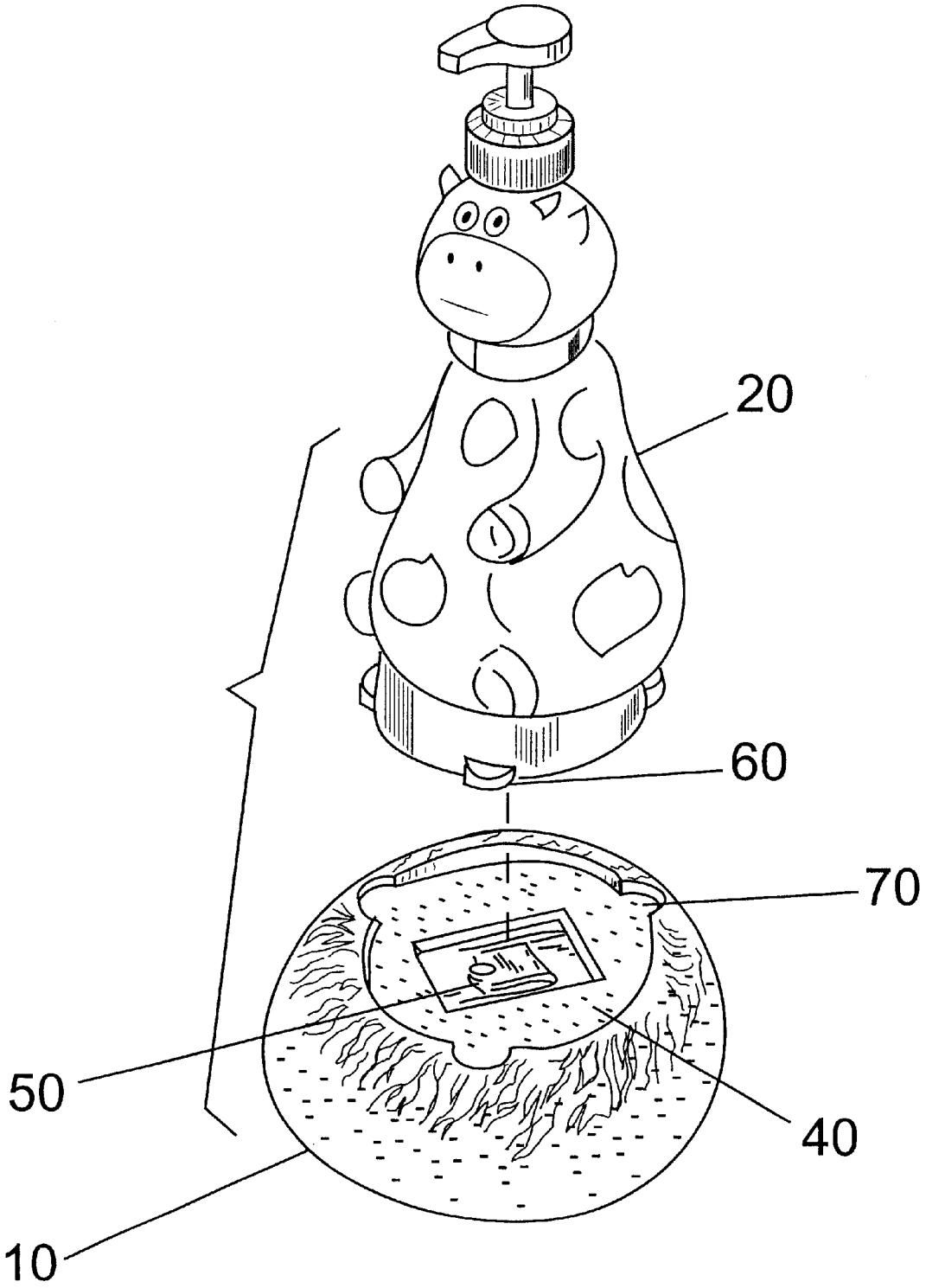
FIG. 27 shows yet another further embodiment of the present invention.

FIG. 26E shows a bottom view of the pressure-activated sound-emitting device 50. FIGS. 26F and 26G shows the front and the back of the pressure activated sound emitting device 50. FIG. 26H shows a side view of the pressure-activated sound-emitting device 50. FIG. 26I shows a bottom view of the pressure activated sound emitting device 50 having a speaker 80. FIG. 27 shows yet another further embodiment of the present invention.

While the invention has been described with respect to use as a lotion dispenser, it is to be understood that the invention can be used to dispense any liquid, including viscous liquids such as creams, lotions, soaps, gels and the like. Of course, with viscous liquids the pump nozzle is suited for dispensing such liquids. Thus, the viscous liquid may not necessarily dispense as a spray, but rather a squirt, stream or drops. Certainly, since the invention is particularly suited for use as a fragrance, cream, lotion, soap or gels, especially, a liquid dispenser, the pump nozzle need not dispense a metered dose or amount of fluid as in medicament dispensers, but, this is not to say that the invention cannot be used to dispense medicaments as the liquid within the dispenser is not necessarily a limitation of the invention.

It is to be further understood that any utilitarian description herein of any component of the dispenser of the invention, for example, the exterior of the dispenser or any feature thereon or the bottle, container, vessel or any feature, e.g., feature thereon, is not to be constructed as a statement that the appearance of any component of the invention is functional in nature or dictated by function. Surface ornamentation or configuration of the dispenser or any components thereof, for example, the exterior of the dispenser or of the bottle, container, vessel, or any portion thereof, are attributable to ornamental considerations.

The pump dispenser 20 and the pedestal 10 are preferably formed from a substantially rigid material, including but not limited to metal, glass, plastics and thermoplastics, either opaque or transparent, preferably polypropylene and ceramics. The pump dispenser can be sculptured and/or molded, e.g., blow-molding in any form or shaped as desired, for example, it can take a shape of an animal, a mammal, an insect, an inanimate object such as a mountain, or a lake, an amphibian such as a frog, and any animated cartoon characters. Specifically, the pedestal 10 is hollow and has an upper and a lower surface. The upper surface of the pedestal has recesses 70 to receive the male adapters 60 from the pump dispenser 20. The lower surface or the bottom surface of the pedestal 10 has at least one small perforation 90 to drain excess liquid in the event that there is an accumulation of liquids in the pedestal 10.

In addition, these perforations may also serve to control the volume of the pressure-activated sound emitting device. For example, when the speaker 80 of the pressure activated sound emitting device 50 is lined-up with one of the perforations 90 of pedestal 10, the volume is increased whereas when the speaker 80 of the pressure activated sound emitting device 50 is facing the bottom of the pump dispenser 20, the volume is decreased. In addition, since the sound emitting liquid dispenser 1 is meant to be used close to sink, there is a possibility that liquid may come into contact with the flexible member 40 and the pressure activated sound emitting device 50, the pressure activated sound emitting device 50 is enclosed within a sealed protective casing such as a plastic sheath in order to isolate the pressure activated sound emitting device 50 from coming into contact with any undesirable substance.

Furthermore, in order to properly secure the pressure activated sound emitting device 50, a fastening device is used to secure the pressure activated sound emitting device 50 inside the pedestal 10. The fastening device could be an adhesive tape. The actuator 30 can be formed from any suitable materials, including metals, plastics and thermoplastics, preferably polypropylene or stainless steel. Particularly, the actuator 30 could be a conventional pump spray nozzle assembly having a screw top that fits within a cavity of the pump dispenser 20 and dispenses substantially perpendicularly to the pumping axis of the pump spray nozzle.

The actuator could also be purchased from either Valois of America, Inc., 15 Valley Drive, Greenwich, Conn. Xiamen Ronoghe Plastics Products Co., Ltd. At China Fenggang Village, Xinmin Town, Tongan, Xiamen. The flexible member 40 could be any foam cushion with memory. The flexible member 40 can be purchased at Xiamen Dahuafu Co., Ltd. At China Lachain Road, Hungshanbin Development Area, Xiamen. The pressure activated sound emitting device could be purchased from Towntechind Co., Ltd. At China Kanghu Lake Huangjiang Town, Dongguan City, Guangdong Province, China.

As can be further appreciated from the foregoing description and the illustrated embodiments, the sound emitting liquid dispenser of the present invention does not necessarily require the spray activator being located at the top of the sound emitting liquid dispenser or that the sound emitting dispenser be set on a stationary surface, or that the dispenser taking any particular shape other than to the potential customers' liking. It is also appreciated that the invention allows freedom in the appearance of the dispenser and that the sound emitting device does not necessarily need be positioned below the dispenser. Further, the sound emitting device can be positioned anywhere in relation to the dispenser so long as the pressure activated sound emitting device can either come into contact with surfaces of the dispenser and/or have pressure for activating the dispenser translated to the sound emitting device and thereby also activate it.

Having thus described in detail preferred embodiments of the present invention, it is to be understood that the invention defined by the appended claims is not to be limited by particular details set forth in the above description, as many apparent variations thereof are possible without departing from the spirit or scope of the present invention.

What is claimed is:

1. A sound emitting and dispensing device comprising:

a pressure-activated pump spray dispenser having a top end having means for a user to apply pressure and engage the dispenser and dispense therefrom and a bottom end;

a pedestal having a bottom end for sitting on a surface, and a top end including means defining an opening for removably receiving the bottom end of the pressure-activated dispenser, and a cavity to receive a flexible member; and a pressure-activated sound emitting device positioned in the means defining an opening for receiving the bottom end of the pressure-activated dispenser;

the flexible member, positioned in the cavity therefor of the pedestal;

wherein the flexible member is a cushion with memory capable of compressing and decompressing and the pressure-activated dispenser is connected to the pedestal and the pressure-activated sound emitting device is positioned beneath the dispenser, such that when the pressure-activated dispenser is so connected to the pedestal and pressure is applied to the top end of the dispenser, the sound emitting device is activated and wherein there is a male member at the bottom end of the pressure-activated dispenser is removably received by a female receptor at the top end of the pedestal.

2. The sound emitting and dispensing device as claimed in claim 1, wherein the flexible member disposed within the cavity of the pedestal is in a surrounding relationship to the pressure-activated sound-emitting device.

3. The sound emitting and dispensing device as claimed in claim 1, wherein the dispensing device is decorative and is in the shape of an animal.

4. The sound emitting and dispensing device as claimed in claim 3, wherein the decorative dispenser is in a form selected from the group consisting of: a dog, a cat, a rooster, a duck, a dolphin, a cow, a tiger, a rabbit, a dragon, a snake, a horse, a sheep, a monkey, a pig, a frog and a seal.

5. The sound emitting and dispensing device as claimed in claim 1, wherein the decorative dispenser is in the form of an inanimate object.

6. The sound emitting and dispensing device as claimed in claim 1, wherein the bottom end of the pressure-activated dispenser has at least one male member.

7. The sound emitting and dispensing device as claimed in claim 1, wherein the top end of the pedestal has at least one female receptor.

8. The sound emitting and dispensing device as claimed in claim 1, wherein the bottom end of the pedestal has at least one perforation.

9. The pump dispenser receiving unit as claimed in claim 1, wherein the electronic pressure-activated sound emitting device is optionally enclosed in a non-conductive protective casing to prevent dust and liquid from coming into contact with the electronic pressure-activated sound emitting device.

* * * * *